US009042792B2

(12) United States Patent
Carter, II et al.

(10) Patent No.: US 9,042,792 B2
(45) Date of Patent: May 26, 2015

(54) TONER DELIVERY SYSTEM FOR A SHAKE-FREE TONER CARTRIDGE

(71) Applicant: Lexmark International, Inc., Lexington, KY (US)

(72) Inventors: James Anthany Carter, II, Lexington, KY (US); Gary Neal Hackney, Georgetown, KY (US); James Richard Leemhuis, Lexington, KY (US); Rodney Evan Sproul, Lexington, KY (US)

(73) Assignee: LEXMARK INTERNATIONAL, INC., LEXINGTON, KY (US)

( * ) Notice: Subject to any disclaimer, the term of this patent is extended or adjusted under 35 U.S.C. 154(b) by 0 days.

(21) Appl. No.: 14/181,954

(22) Filed: Feb. 17, 2014

(65) Prior Publication Data

US 2014/0199097 A1 Jul. 17, 2014

Related U.S. Application Data

(63) Continuation of application No. 13/340,853, filed on Dec. 30, 2011, now Pat. No. 8,660,469.

(51) Int. Cl.
*G03G 15/08* (2006.01)

(52) U.S. Cl.
CPC .... *G03G 15/0865* (2013.01); *G03G 2215/0819* (2013.01); *G03G 15/0887* (2013.01); *G03G 15/0875* (2013.01)

(58) Field of Classification Search
None
See application file for complete search history.

(56) References Cited

U.S. PATENT DOCUMENTS

| | | | | |
|---|---|---|---|---|
| 5,655,195 | A * | 8/1997 | Ichikawa et al. | 399/263 |
| 6,418,290 | B1 * | 7/2002 | Isomura et al. | 399/254 |
| 6,459,876 | B1 | 10/2002 | Buchanan et al. | |
| 6,496,662 | B1 | 12/2002 | Buchanan et al. | |
| 7,433,632 | B2 | 10/2008 | Askren et al. | |
| 7,532,843 | B2 | 5/2009 | Kern et al. | |
| 8,059,993 | B2 | 11/2011 | Gayne et al. | |
| 8,660,469 | B2 | 2/2014 | Carter, II et al. | |
| 8,688,016 | B2 | 4/2014 | Carter, II et al. | |
| 2007/0269238 | A1 | 11/2007 | Sato | |
| 2008/0095553 | A1 | 4/2008 | Tanaka et al. | |
| 2008/0226351 | A1 | 9/2008 | Dawson et al. | |
| 2009/0060588 | A1 | 3/2009 | Tanaka | |
| 2009/0087222 | A1 * | 4/2009 | Mase et al. | 399/255 |
| 2011/0008076 | A1 | 1/2011 | Kuroyama | |
| 2013/0170875 | A1 | 7/2013 | Sproul et al. | |

OTHER PUBLICATIONS

International Search Report and Written Opinion of the International Searching Authority dated Feb. 15, 2013 for PCT Application No. PCT/US12/67716 (6 pages).

* cited by examiner

*Primary Examiner* — Clayton E Laballe
*Assistant Examiner* — Victor Verbitsky
(74) *Attorney, Agent, or Firm* — Justin M. Tromp

(57) ABSTRACT

A toner delivery system for a shake-free toner cartridge comprises a toner paddle assembly having a plurality of scrapers. A main scraper scrapes toner adhering to interior surfaces and directs toner from a first region of the toner reservoir into the opening in a first portion of the front of the housing. A secondary scraper positioned adjacent with the main scraper scrapes and directs toner from a second region of the toner reservoir into the first region. A side scraper scrapes toner adhering to interior surfaces of respective side walls of the housing.

8 Claims, 14 Drawing Sheets

TONER DELIVERY SYSTEM FOR A SHAKE-FREE TONER CARTRIDGE

CROSS REFERENCES TO RELATED APPLICATIONS

This patent application is a continuation application of U.S. patent application Ser. No. 13/340,853, filed Dec. 30, 2011, entitled "A Toner Delivery System for a Shake-Free Toner Cartridge." The present application is also related to U.S. patent application Ser. No. 13/340,866, filed Dec. 30, 2011, entitled "Paddle Assembly For A Shake-Free Toner Cartridge."

BACKGROUND

1. Field of the Invention

The present disclosure relates generally to toner cartridges used in electrophotographic imaging devices such as a printer or multifunction device having printing capability, and in particular to toner delivery systems used for toner cartridges.

2. Background Information

In a typical electrophotographic imaging device such as a printer, a toner cartridge supplies toner to the apparatus through a toner supply port in the toner cartridge. In such toner cartridges, a torque based toner level sensing method is commonly used to provide an indication for the customer when the toner cartridge is low and out of toner. A one-sided paddle is incorporated within the toner cartridge to determine the torque at a known position to sense the level of toner in the sump. The paddle is driven by a motor and gear train to rotate about the interior of the toner cartridge. A film strip, typically made of polyethylene terephthalate (PET) material, such as MYLAR®, may be connected to the distal ends of the paddle to sweep toner from along the wall of the interior into the toner supply port. However, in such toner cartridges, having any portion of the paddle touching the housing wall would interfere with the torque based toner level measurement. As such, toner delivery may not be fully efficient such that not all of the toner is successfully delivered at the end of the toner cartridges life and there may still be residual toner left in the toner cartridge. To get this residual toner out of the cartridge customers remove the toner cartridge from the printer and shake. However, shaking the toner cartridge may sometimes result in dropping the cartridge, toner leaks and toner cartridge malfunction.

A need therefore exists for a toner delivery system that eliminates the need for shaking of the cartridge, a toner delivery system that provides a reliable and consistent supply of toner to an image forming apparatus until the toner cartridge is empty and minimizes the residual toner left in the toner cartridge at the end of life.

SUMMARY OF THE DISCLOSURE

A toner cartridge for an imaging device comprises paddle assembly having multiple scrapers for removing toner from the interior surfaces of a toner reservoir of a toner cartridge and delivering toner to the imaging device. The toner cartridge has a housing having a top and a base having a front, rear, bottom, a first side, and a second side with interior surfaces of the top and base forming an enclosed reservoir for holding a quantity of toner. The front of the housing has a first portion having an opening into a first region of the reservoir and extending along a width of the first portion and a second solid portion. A paddle assembly is rotatably mounted within the enclosed reservoir below the opening in the front of the housing. The paddle assembly comprises a drive shaft having ends rotatably mounted through corresponding openings in the first and second sides, a frame mounted on the drive shaft having a pair of aligned arms, an arm positioned near each of the first and second sides and radially extending therefrom, and a cross member connected to distal ends of the pair of aligned arms. A main scraper is mounted in cantilevered manner from a first segment of the cross member and has an interference contact with the interior surfaces of the front, top, rear and bottom of the housing. A secondary scraper is mounted in a cantilevered manner from a second segment of the cross member and has an interference contact with the interior surfaces of the front, top, rear and bottom of the housing and is positioned in an overlapping relation with the main scraper with a portion of the main scraper positioned outwardly in front of a portion of the secondary scraper. A toner exit assembly is provided having an exit port in communication with the opening in the first portion of the front of the housing, the toner exit assembly delivering toner received from the reservoir via the opening to the exit port. During rotation of the paddle assembly, the main scraper and the secondary scraper scrape toner adhering to interior surfaces of the front, rear, and bottom of the housing. A distal portion of the main scraper directs toner from the first region of the reservoir into the opening in the first portion of the front of the housing, and a distal portion of the secondary scraper directs toner from a second region of the reservoir into the first region of the reservoir.

In one embodiment, the second segment of the cross member is at an acute angle with respect to the first segment of the cross member while in another form the second segment of the cross member is offset from and parallel to the first segment of the cross member. In a still further embodiment a side scraper mounted in a cantilevered manner on an arm of the pair of aligned arms has an interference contact with the adjacent side for cleaning the sides of the toner cartridge.

In a still further form the main scraper includes a notch having a catch formed on an outer side edge of the main scraper and the side scraper has a notch in a bottom edge. The catch of the main scraper receives the bottom edge of the side scraper during assembly of the top to the base. The catch holds the side scraper away from a weld area formed during attachment of the top to the base. During initial rotation of the paddle assembly, the notch in the side scraper aligns with the catch in the main scraper releasing the bottom edge of the side scraper from the main scraper and moving the bottom edge of the side scraper into the interference contact with the adjacent side.

In a still further form, the paddle assembly further comprises a space formed between an inner member and an outer member of the arm on which the side scraper is mounted. A base portion of the side scraper is inserted through the space, wrapped over the inner member, and mounted on an inner side of the inner member. The force applied by the side scraper to the adjacent side wall is dependent upon the width of the spacing between the outer and inner members of the arm. The outer member of the arm of the pair of arms may also be at an acute angle with respect to the inner member of the arm wherein the angle of the outer member controls an extent of the contact along the bottom edge of the side scraper with the adjacent side wall.

BRIEF DESCRIPTION OF DRAWINGS

Features and advantages of the present disclosure are set forth herein by description of embodiments consistent with the present disclosure, which description should be considered in conjunction with the accompanying drawings.

DETAILED DESCRIPTION

Figure 1:
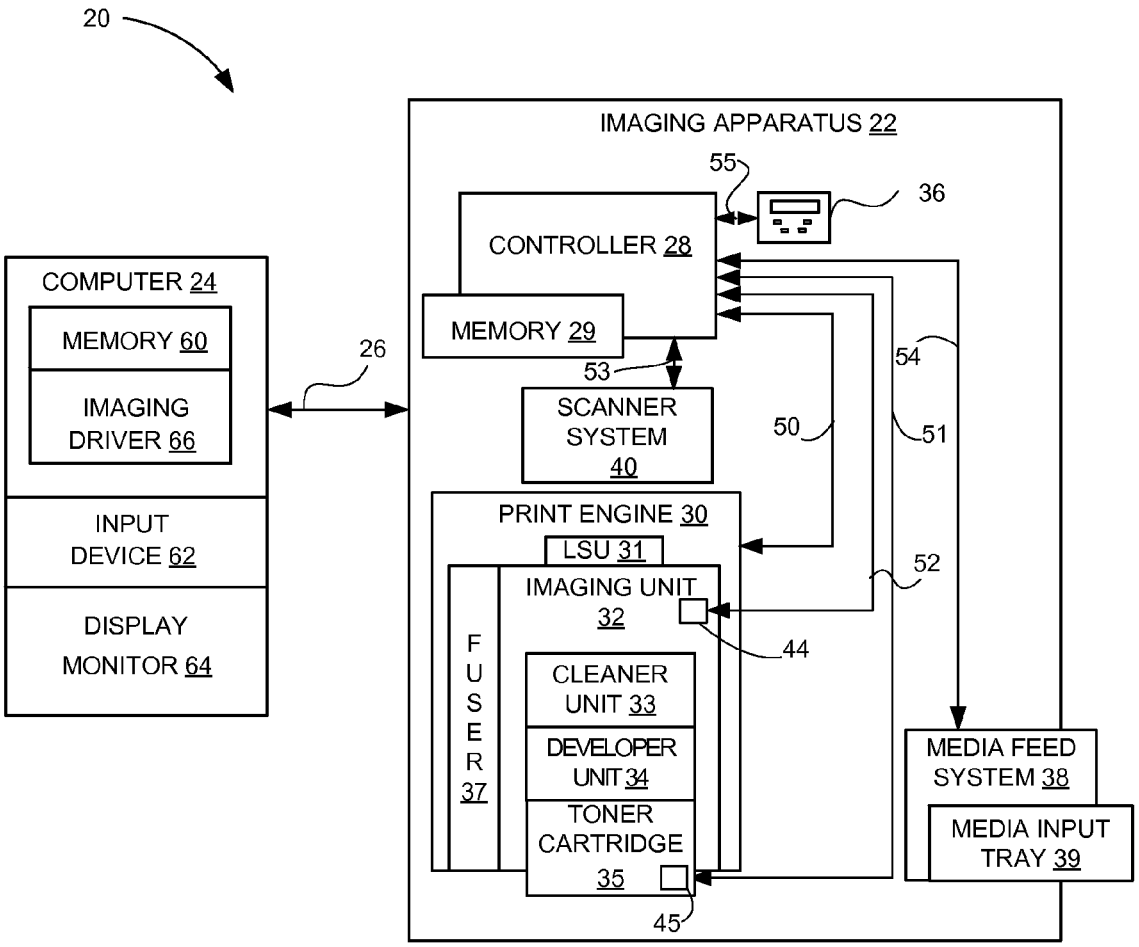
FIG. 1 is a block diagram of an imaging system according to one example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side", "under", "below", "lower", "over", "upper", and the like, are used for ease of description to explain the positioning of one element relative to a second element. These terms are generally used in reference to the position of an element in its intended working position within an imaging device. The terms "left" and "right" are as viewed with respect to the insertion direction of a unit into the imaging device. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate multiple functions such as scanning, copying, and printing capabilities in one device. The term button as used herein means any component, whether a physical component or graphic user interface icon, that is engaged to initiate output.

Referring now to the drawings and particularly to FIG. 1, there is shown a diagrammatic depiction of an imaging system 20 embodying the present invention. As shown, imaging system 20 may include an imaging apparatus 22 and a computer 24. Imaging apparatus 22 communicates with computer 24 via a communications link 26. As used herein, the term "communications link" is used to generally refer to structure that facilitates electronic communication between multiple components, and may operate using wired or wireless technology and may include communications over the Internet. Imaging system 20 may be, for example, a customer imaging system, or alternatively, a development tool used in imaging apparatus design.

In the embodiment shown in FIG. 1, imaging apparatus 22 is shown as a multifunction machine that includes a controller 28, a print engine 30, a laser scan unit (LSU) 31, an imaging unit 32, a cleaner unit 33, a developer unit 34, a toner cartridge 35, a user interface 36, a media feed system 38 and media input tray 39 and a scanner system 40. Imaging apparatus 22 may communicate with computer 24 via a standard communication protocol, such as for example, universal serial bus (USB), Ethernet or IEEE 802.xx. A multifunction machine is also sometimes referred to in the art as an all-in-one (AIO) unit. Those skilled in the art will recognize that imaging apparatus 22 may be, for example, an electrophotographic printer/copier including an integrated scanner system 40; or a standalone scanner system 40.

Controller 28 includes a processor unit and associated memory 29, and may be formed as one or more Application Specific Integrated Circuits (ASICs). Memory 29 may be any volatile on non-volatile memory or combinations thereof such as, for example, random access memory (RAM), read only memory (ROM), flash memory, and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the present embodiment, controller 28 communicates with print engine 30 via a communications link 50. Controller 28 communicates with imaging unit 32 and processing circuitry 44 thereon via a communications link 52. Controller 28 communicates with toner cartridge 35 and processing circuitry 45 therein via a communications link 51. Controller 28 communicates with media feed system 38 via a communications link 54. Controller 28 communicates with scanner system 40 via a communications link 53. User interface 36 is communicatively coupled to controller 28 via a communications link 55. Processing circuit 44 and 45 may provide authentication functions, safety and operational interlocks, operating parameters and usage information related to imaging unit 32 or toner cartridge 35, respectively. Controller 28 serves to process print data and to operate print engine 30 during printing, as well as to operate scanner system 40 and process data obtained via scanner system 40.

Computer 24, which may be optional, may be, for example, a personal computer, network server, tablet computer, smartphone or other hand-held electronic device, including memory 60, such as volatile and/or non-volatile memory, input device 62, such as a keyboard, and a display, such as monitor 64. Computer 24 further includes a processor, input/output (I/O) interfaces, and may include at least one mass data storage device, such as a hard drive, a CD-ROM and/or a DVD unit (not shown).

Computer 24 includes in its memory a software program including program instructions that function as an imaging driver 66, e.g., printer/scanner driver software, for imaging apparatus 22. Imaging driver 66 is in communication with controller 28 of imaging apparatus 22 via communications link 26. Imaging driver 66 facilitates communication between imaging apparatus 22 and computer 24. One aspect of imaging driver 66 may be, for example, to provide formatted print data to imaging apparatus 22, and more particularly, to print engine 30, to print an image. Another aspect of imaging driver 66 may be, for example, to facilitate collection of scanned data.

In some circumstances, it may be desirable to operate imaging apparatus 22 in a standalone mode. In the standalone mode, imaging apparatus 22 is capable of functioning without computer 24. Accordingly, all or a portion of imaging driver 66, or a similar driver, may be located in controller 28 of imaging apparatus 22 so as to accommodate printing and scanning functionality when operating in the standalone mode.

Print engine 30 may include a laser scan unit (LSU) 31, an imaging unit 32, a toner cartridge 35, and a fuser 37, all mounting within imaging apparatus 22. The imaging unit 32 further includes a cleaner unit 33 housing a waste toner removal system and a photoconductive drum, a developer unit 34 that are removably mounted within imaging unit 32. In one embodiment the cleaner unit 33 and developer unit 34 are assembled together and installed into a frame of the imaging unit 32. The toner cartridge 35 is then installed in the frame in a mating relation with the developer unit 34. Laser scan unit 31 creates a latent image on the photoconductive drum in the cleaner unit 33. The developer unit 34 has a toner sump containing toner which is transferred to the latent image on the photoconductive drum to create a toned image. The toned image is subsequently transferred to a media sheet received in the imaging unit 32 from media input tray 38 for printing. Toner remnants are removed from the photoconductive drum by the waste toner removal system. The toner image is bonded to the media sheet in the fuser 37 and then sent to an output location or to one or more finishing options such as a duplexer, a stapler or hole punch.

The toner cartridge 35 removably mates with the developer unit 34 in imaging unit 32. An exit port on the toner cartridge 35 communicates with an inlet port on the developer unit 34 allowing toner to be periodically transferred from the toner cartridge 35 to resupply the toner sump in the developer unit 34.

Figure 2:
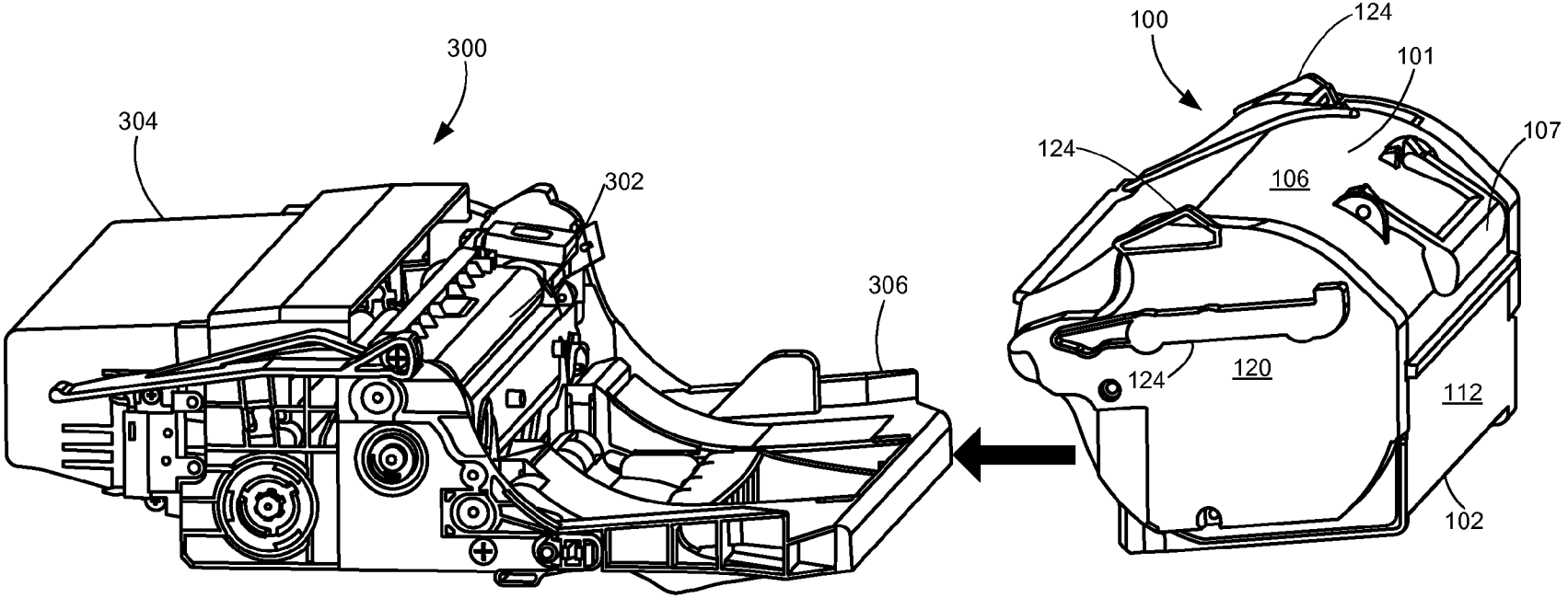
FIG. 2 is a perspective view of a toner cartridge and an imaging unit according to one example embodiment.

Referring now to FIG. 2, a toner cartridge 100 and an imaging unit 300 are shown according to one example embodiment. Imaging unit 300 includes a developer unit 302 and a cleaner unit 304 mounted on a common frame 306. As discussed above, imaging unit 300 and toner cartridge 100 are each removably installed in the image forming device. Imaging unit 300 is first slidably inserted into the image forming device. Toner cartridge 100 is then inserted into the image forming device and onto frame 306 in a mating relationship with developer unit 302 of imaging unit 300 as indicated by the arrow shown in FIG. 2. This arrangement allows toner cartridge 100 to be removed and reinserted easily when replacing an empty toner cartridge without having to remove imaging unit 300. Should a media jam occur beneath the imaging unit 300, the toner cartridge 100 and imaging unit 300 may be readily removed to allow access to the media jam. The developer unit 302, cleaner unit 304 and frame 306 may also be readily removed as desired in order to maintain, repair or replace the components associated with developer unit 302, cleaning unit 304 or frame 306; however, it will be appreciated that this typically occurs with less frequency than the removal and reinsertion of toner cartridge 100.

Figure 3:
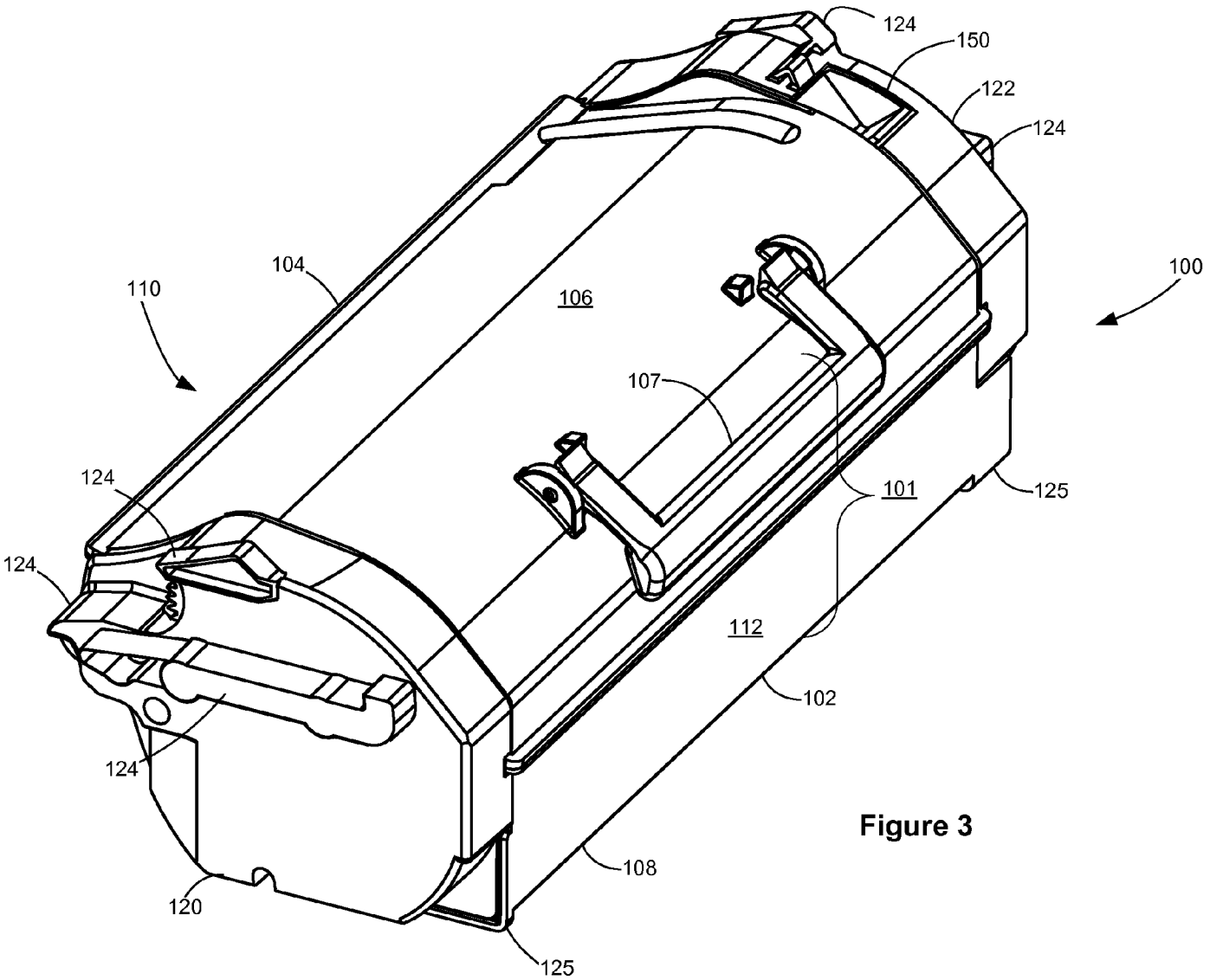
FIG. 3 is an additional perspective view of the toner cartridge shown in FIG. 2.
Figure 4:
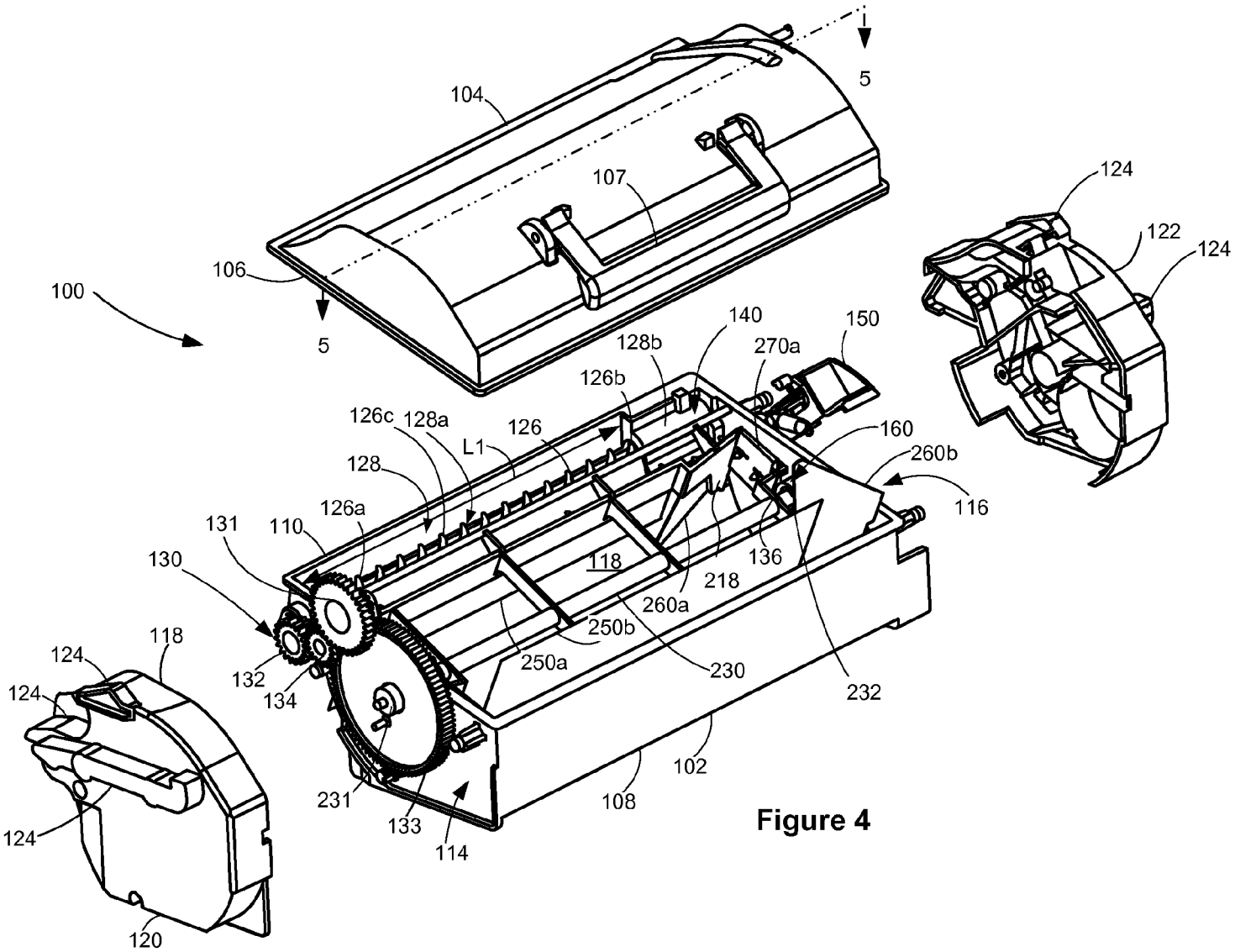
FIG. 4 is an exploded view of the toner cartridge shown in FIG. 2 showing a reservoir for holding toner therein.
Figure 5:
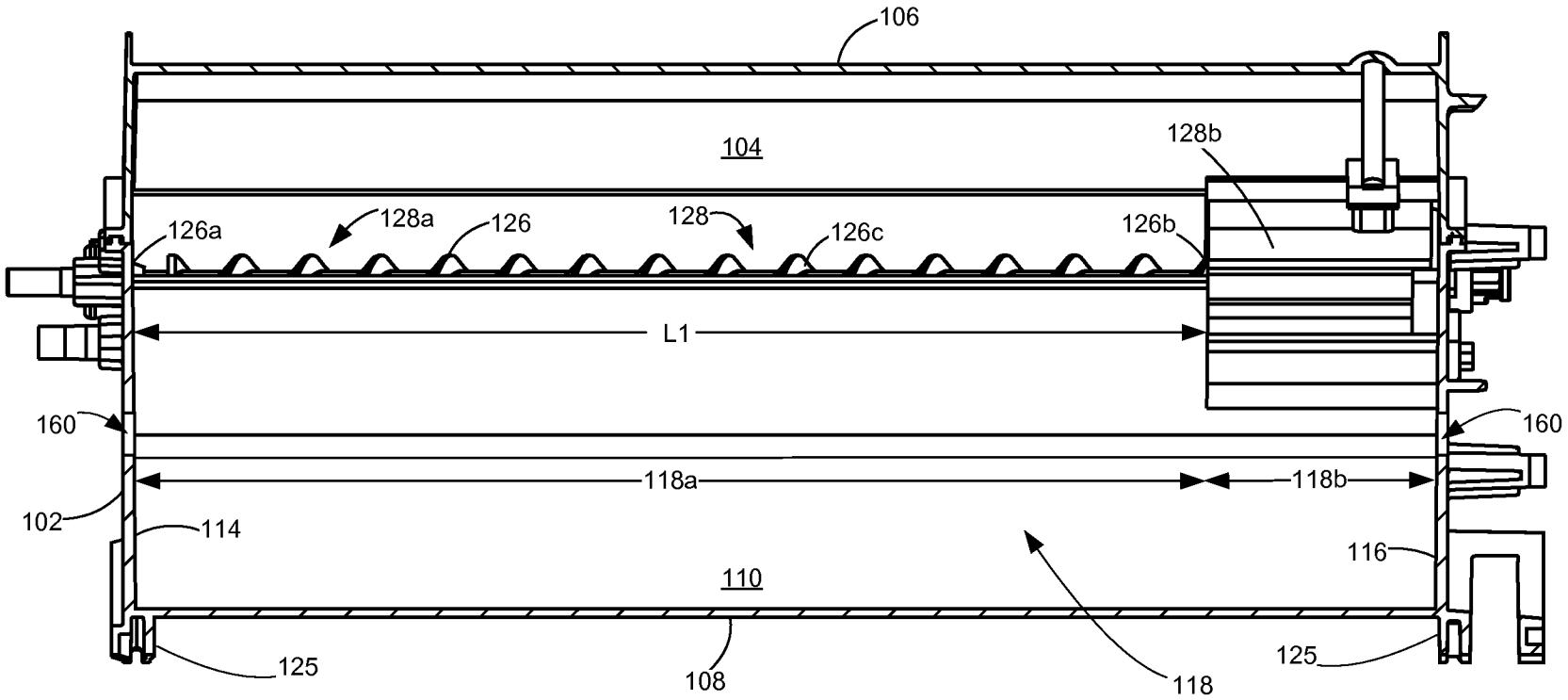
FIG. 5 is a sectional view of the toner cartridge taken along the line 5-5 in FIG. 4 showing the auger and the exit port.

Referring now to FIGS. 3-5, toner cartridge 100 comprises a housing 101 having a toner reservoir 118 for holding a quantity of toner. Housing 101 may be viewed as having a top or lid 106 mounted on a base 102. Base 102 includes a bottom 108 having thereon first and second side walls or end walls 114, 116, connected to adjoining front and rear walls 110, 112. Top 106 may be ultrasonically welded to base 102 forming toner reservoir 118. Because the toner reservoir generally has the shape of a cylinder having a circular or oval, the interior surfaces of the bottom 108, front and rear walls 110, 112, and the top 106 may be said to form a circumferential wall. First and second end caps 120, 122 are also mounted to housing 101 at first and second side walls 114, 116, respectively, and include guides 124 to assist with inserting toner cartridge 100 into frame 306 of the imaging unit 300 for mating with developer unit 302.

First and second end caps 120, 122 may be snap fitted into place or attached by screws or other forms of fasteners. Guides 124 travel in channels provided within the housing of the imaging apparatus. Legs 125 may also be provided on a bottom portion 108 of base 102 and/or on end caps 120, 122 to assist with the insertion of toner cartridge 100 into the imaging unit 300. Legs 125 are received by a corresponding slot or channel in frame 306 to facilitate the mating of toner cartridge 100 with developer unit 302. A handle 107 may be provided on top 106 or base 102 of toner cartridge 100 to assist with insertion and removal of toner cartridge 100 from imaging unit 300 and the image forming device.

With reference to FIGS. 4 and 5, various drive gears are housed within a space formed between first end cap 120 and side wall 114, and various interlocks 150 and linkages may also be housed within the space formed between second end cap 122 and second side wall 116. A main interface gear 131 engages with a drive system in the imaging apparatus 22 that provides torque to main interface gear 131. As discussed in greater detail below, various linkages are housed within a space formed between first end cap 120 and side wall 114. One or more paddle assemblies 200 may be rotatably mounted within toner reservoir 118 with first and second ends 231, 232 of a drive shaft 230 of paddle assembly 200 extending through aligned openings 160 in side walls 114, 116, respectively (see FIG. 8). A drive gear 133 is provided on the first end 231 of drive shaft 230 that engages with main interface gear 131 either directly or via one or more intermediate gears 134. Accordingly, first side wall 114 may also be termed the "drive" or "driven" side of toner cartridge 100.

An auger 126 having first and second ends 126*a*, 126*b*, and a spiral screw flight 126*c* is positioned in a channel 128 extending along the width of front wall 110 between side walls 114, 116. Channel 128 may be integrally molded as part of front wall 110 or be formed as a separate component that is attached to front wall 110. Channel 128 is generally horizontal in orientation along with toner cartridge 100 when toner cartridge 100 is installed in the image forming device. First end 126*a* of auger 126 extends through first side wall 114 and is connected to a gear (not shown) that engages with main interface gear 131 either directly or via one or more intermediate gears 132, 134. Channel 128 includes an open portion 128*a* having a length L1 (which in one example embodiment is approximately 200 mm) corresponding to the opening in front 110 into the toner reservoir 118 and an enclosed portion 128*b*. Open portion 128*a* is open to toner reservoir 118 and extends from first side wall 114 toward second end 126*b* of auger 126. Enclosed portion 128*b* of channel 128 extends from second side wall 116 toward second end 126*b* of auger 126 and encloses a shutter assembly (not shown) and the second end 126*b* of auger 126. The shutter assembly is used to open and close exit port 140 located in the enclosed portion 128*b* of channel 128. As paddle assembly 200 rotates, it delivers toner from toner reservoir 118 into open portion 128*a* of channel 128. Auger 128 is rotated to deliver toner received in channel 128 to a shutter assembly (not shown) housed in enclosed portion 128*b* of channel 128. In this example embodiment, exit port 140 is disposed at the bottom of the enclosed portion 128*b* of channel 128 so that gravity will assist the delivery of toner dropping through exit port 140.

Referring to FIGS. 4 and 5, in one example embodiment of a toner cartridge 100, channel 128 and the rotational centerline of the auger 126 are positioned above the axis of rotation of the toner paddle drive shaft 230. As such, toner must be lifted up from reservoir 118 for delivery into channel 128 and auger 126.

Figure 6:
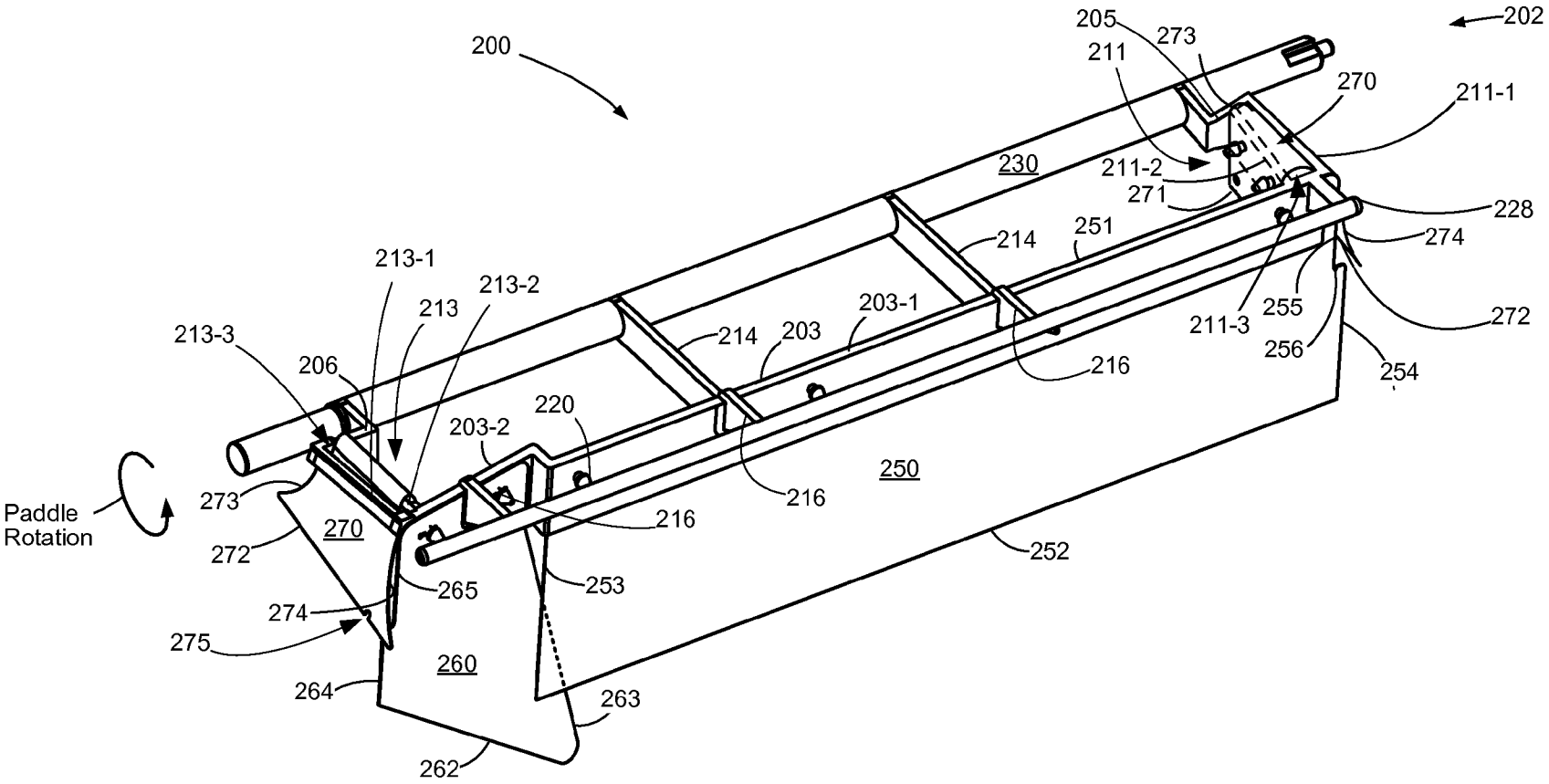
FIG. 6 is a perspective view of one example embodiment of a toner paddle of the present invention.
Figure 8:
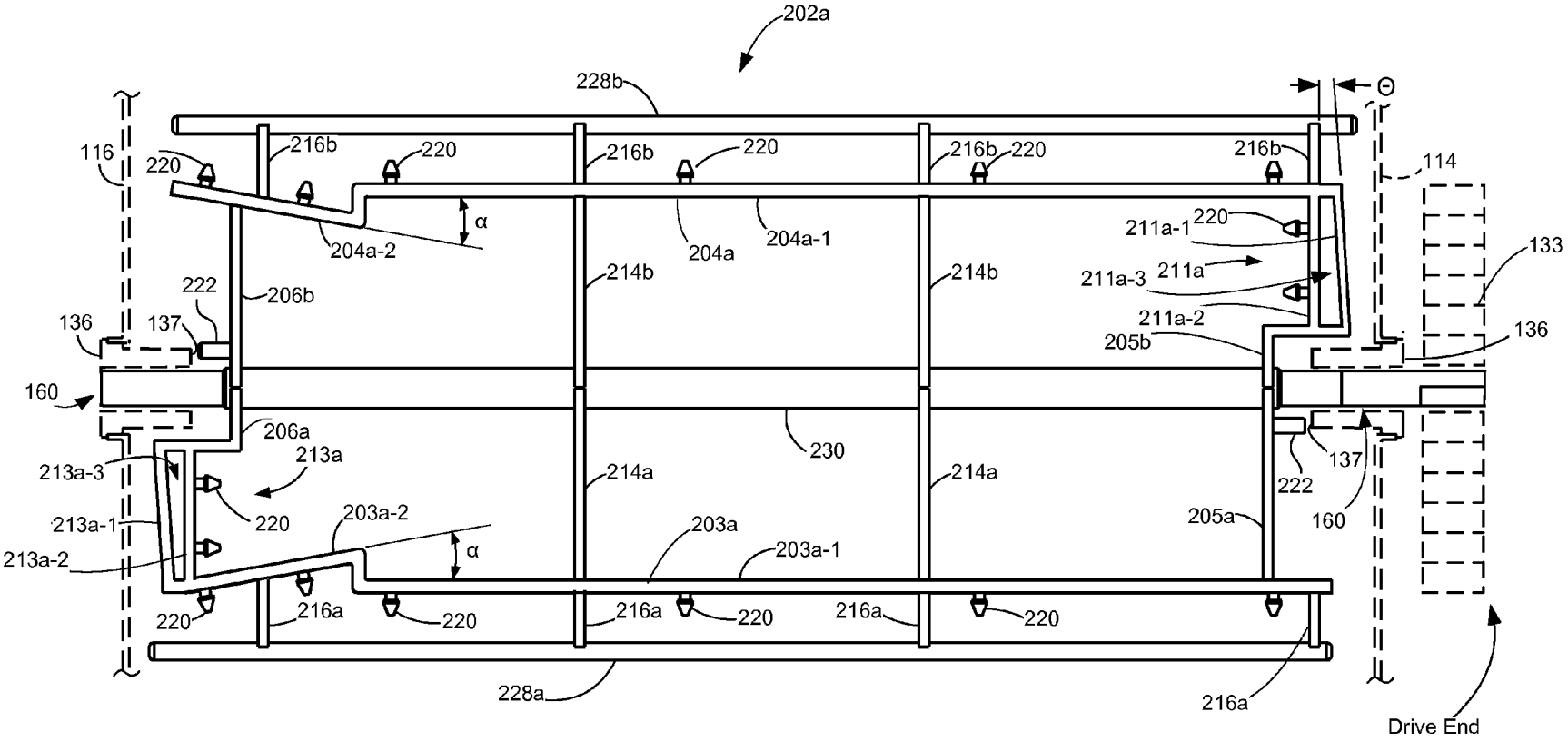
FIG. 8 is a view of an example embodiment of a toner paddle frame including a breaker bar attached to a cross member of the frame with the cross member having angled portions.

In one example embodiment of a toner paddle assembly shown in FIG. 6, the toner paddle assembly 200 comprises a frame 202 formed by a set of aligned arms comprising a first end member 205, a second end member 206, and one or more ribs 214 radially extending from a drive shaft 230 and a cross member 203 connected to distal ends of the set of aligned arms. The frame 202 may be molded unitarily with the drive shaft 230. The set of aligned arms radially extend from the drive shaft 230 with ribs 214 interspaced between the first and second end members 205, 206. The cross member 203 includes a first segment 203-1 for mounting a main scraper 250, and a second segment 203-2, shown at an angle α (in one example embodiment this angle is about 10 degrees) with respect to the first segment 203-1. Second segment 203-2 may also be angled inwardly or outwardly with respect to first segment 203-1 (FIGS. 6 and 8 illustrate an inwardly angled offset arrangement), for mounting a secondary scraper 260. First segment 203-1 has a length corresponding to the open portion 128*a* of channel 128 while second segment 203-2 has an effective length corresponding to the length of the enclosed portion 128*b* of channel 128. The actual length of second segment 203-2 is actually slightly longer than the length of enclosed portion 128*b* due to it being at an angle.

First and second end members 205, 206 may include offset portions 211, 213, respectively, each for mounting a side scraper 270. The end members 205, 206 include axially offset portions 211, 213, respectively, each for mounting the side scrapers 270. Offset portions 211, 213, are formed in their respective end members 205, 206, and each have a pair of spaced, generally radial members 211-1, 211-2, and 213-1, 213-2 respectively. The base portion 270-1 of each of the side scrapers 270 is inserted through the space 211-3, 213-3 between these members and is wrapped around member 211-1, 213-1. The inner face of the inner members 211-2, 213-2 may have one or more mounting stakes 220 which are used to secure side scrapers 270. Offset portions 211, 213 are positioned near side walls 114, 116, respectively. Inner member 211-2, 213-2 is generally parallel to side wall 114, 116, respectively, while outer member 211-1, 213-1 forms an acute angle with its respective inner member 211-2, 213-2 (see FIGS. 9, 14 and 15). The structure and function of offset portions 211, 213 will be further described with reference to the offset portions illustrated in FIGS. 13-15.

Figure 7:
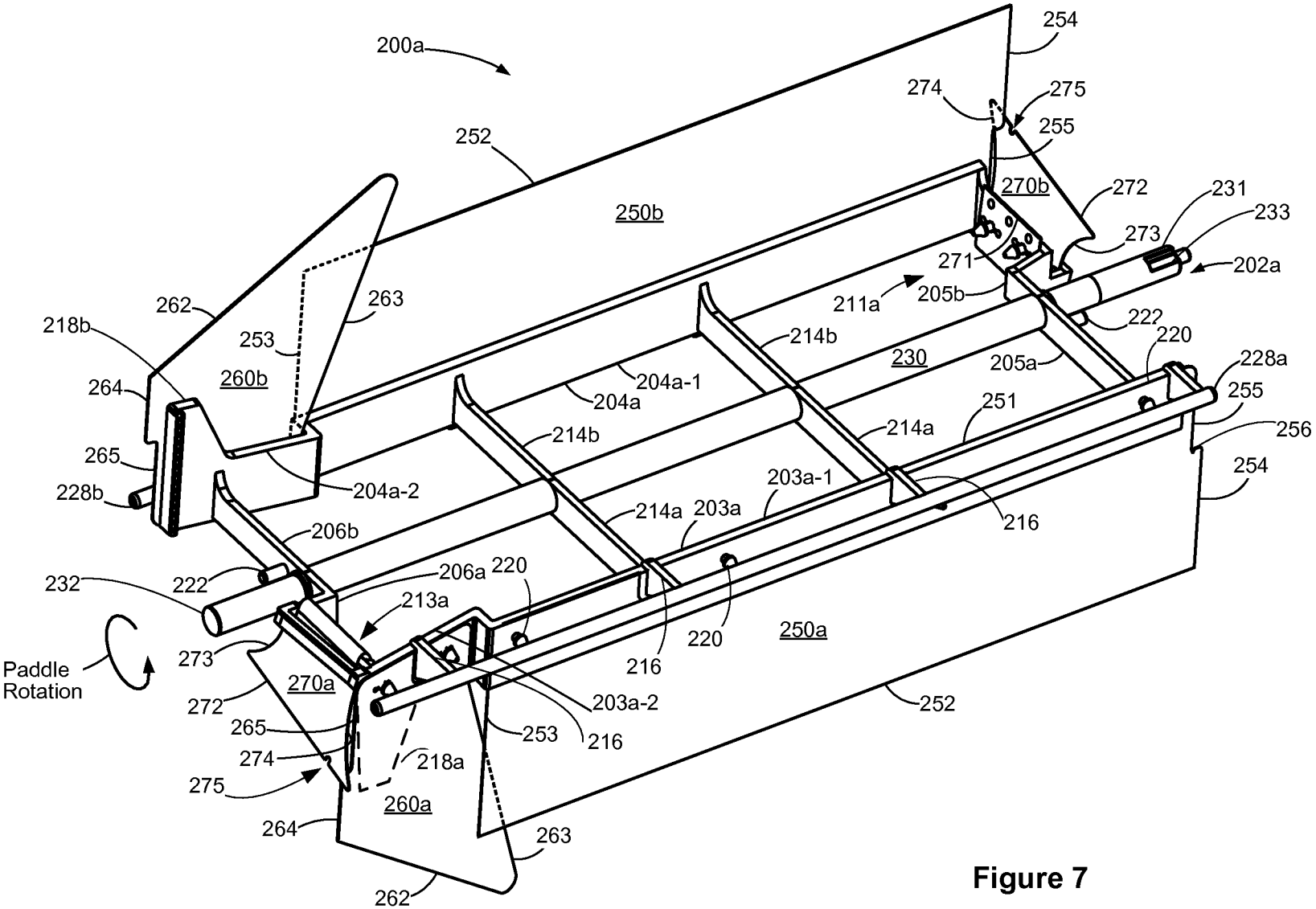
FIG. 7 is a perspective view of another example embodiment of a toner paddle.

Another example embodiment of a toner paddle is shown in FIGS. 7 and 8. This embodiment is similar to the one-sided toner paddle assembly 200 of FIG. 6 but is dual-sided. The toner paddle assembly 200*a* comprises a frame 202*a* formed by two sets of aligned arms extending radially from a drive shaft 230. The frame 202*a* may be molded unitarily with the drive shaft 230. The first set of aligned arms includes first and second end members 205*a*, 206*a*, and a plurality of rib members 214*a* interspaced between first and second end members 205*a*, 206*a*. A front cross member 203*a* connects the distal ends of the first set of arms. Front cross member 203*a* includes a first segment 203*a*-1 for mounting a main scraper 250*a*, and a second segment 203*a*-2 for mounting a secondary scraper 260*a*. Rear cross member 204*a* connects the distal ends of the second set of arms. The second set of aligned arms extend radially opposite the arms of the first set and include first and second end members 205*b*, 206*b*, and a plurality of rib members 214*b* interspaced between first and second end members 205*b*, 206*b*. The end members and ribs stiffen frame 202*a*. Rear cross member 204*a* includes a first segment 204*a*-1 for mounting a main scraper 250*b*, and a second segment 204*a*-2 for mounting a secondary scraper 260*b*. Cross member 204*a*, as illustrated, is a mirror image of cross member 203*a*. The front cross member 203*a* and the rear cross member 204*a* are arranged generally parallel to the drive shaft 230, are generally parallel to the interior surface of toner reservoir 118, and face each other with the drive shaft 230 in between. First segment 203*a*-1 has a length corresponding to the open portion 128*a* of channel 128 while second segment 203*a*-2 has an effective length corresponding to the length of the enclosed portion 128*b* of channel 128. The actual length of second segment 203*a*-2 is actually slightly longer than the length of enclosed portion 128*b* due to it being at an angle. First segments 203*a*-1, 204*a*-1 and second segments 203*a*-2, 204*a*-2 have lengths corresponding to the length of the open portion 128*a* and enclosed portion 128*b*, respectively, of channel 128.

As illustrated end members 205*a*, 206*b* extending radially from drive shaft 230 and do not have any offset portions. The end members 205*b*, 206*a* include axially offset portions 211*a*, 213*a*, respectively, each for mounting side scrapers 270*b*, 270*a*, respectively. Offset portions 211*a*, 213*a* are formed in their respective end members 205*b*, 206*a*. Offset portions 211*a*, 213*a* are positioned near side walls 114, 116, respectively shown in dashed lines in FIG. 8. Offset portions 211*a*, 213*a*, each further comprise a radially extending outer member 211*a*-1, 213*a*-1, and a radially extending inner member, 211*a*-2, 213*a*-2 having an opening 211*a*-3, 213*a*-3, respectively, therebetween Inner members 211*a*-2, 213*a*-2 are axially inward of outer members 211*a*-3, 213*a*-1, respectively. The inner face of the inner members 211*a*-2, 213*a*-2 may have one or more mounting stakes 220 which are used to secure side scrapers 270*b*, 270*a* to the frame 202*a* Inner members 211*a*-2, 213*a*-2 are generally parallel to side wall 114, 116, respectively while outer members 211*a*-1, 213*a*-1 form an acute angle θ (in one example embodiment this angle is 3.6 deg) with their respective inner members 211*a*-2, 213*a*-2 (see FIGS. 8, 14 and 15). Although angle θ is shown as being the same for outer members 211*a*-1, 213*a*-1, the angle of the outer member 211*a*-1 and the angle of outer member 213*a*-1 may be different from one another. Each main scraper 250*a*, 250*b* is mounted on an outer surface of first segments 203*a*-1, 204*a*-1 of the cross members 203*a*, 204*a*, respectively. Each main scraper 250*a*, 250*b* extends over the length of the first segments 203*a*-1, 204*a*-1, of cross members 203, 204. The main and secondary scrapers may also be mounted from the inner surfaces of the cross members.

The frame 202*a* includes one or more centering posts 222 positioned near the drive shaft 230 and extending axially outwardly from the end members. As shown a centering post 222 axially extends from each of the first end member 205*a* and second end member 206*b* in parallel with the drive shaft 230. As illustrated in the example embodiment, the centering posts 222 each engage an inner end surface 137 of the sleeve bearings 136 mounted on side walls 114, 116, respectively, thereby restraining the toner paddle assembly 200*a* from any lateral or axial movement during its rotation. By positioning the centering posts 222 to contact the bearing, more of the surface of side walls 114, 116 may be scraped by side scrapers 270*a*, 270*b*. In one example embodiment illustrated in FIG. 8, the frame 202*a* may further include a plurality of extension ribs 216*a*, 216*b* extending radially outwardly from each of the front cross member 203*a* and rear cross member 204*a*, respectively. A breaker bar 228*a*, 228*b* connects the distal ends of the extension ribs 216*a*, 216*b*, respectively. The breaker bar 228*a*, 228*b* may be formed of various shapes, such as rectangular or circular. Each breaker bar 228*a*, 228*b* is positioned to be as close as possible to the inner wall of housing 101 without making contact. As the breaker bars 228*a*, 228*b* rotate, toner packed against the inner wall of housing 101 is broken apart. Toner tends to adhere together and pack when a toner cartridge has been left in a hot environment for a long period of time. Once the toner is broken up by the breaker bar 228*a*, 228*b*, the main scraper 250*a*, 250*b* is able to dig into the toner and deliver it from the toner reservoir 118 into the open portion 128*a* of channel 128. While two breaker bars are shown, a single breaker bar may be used. Breaker bars and extension ribs may also be used with the frames 202 and 202*b*.

Figure 9:
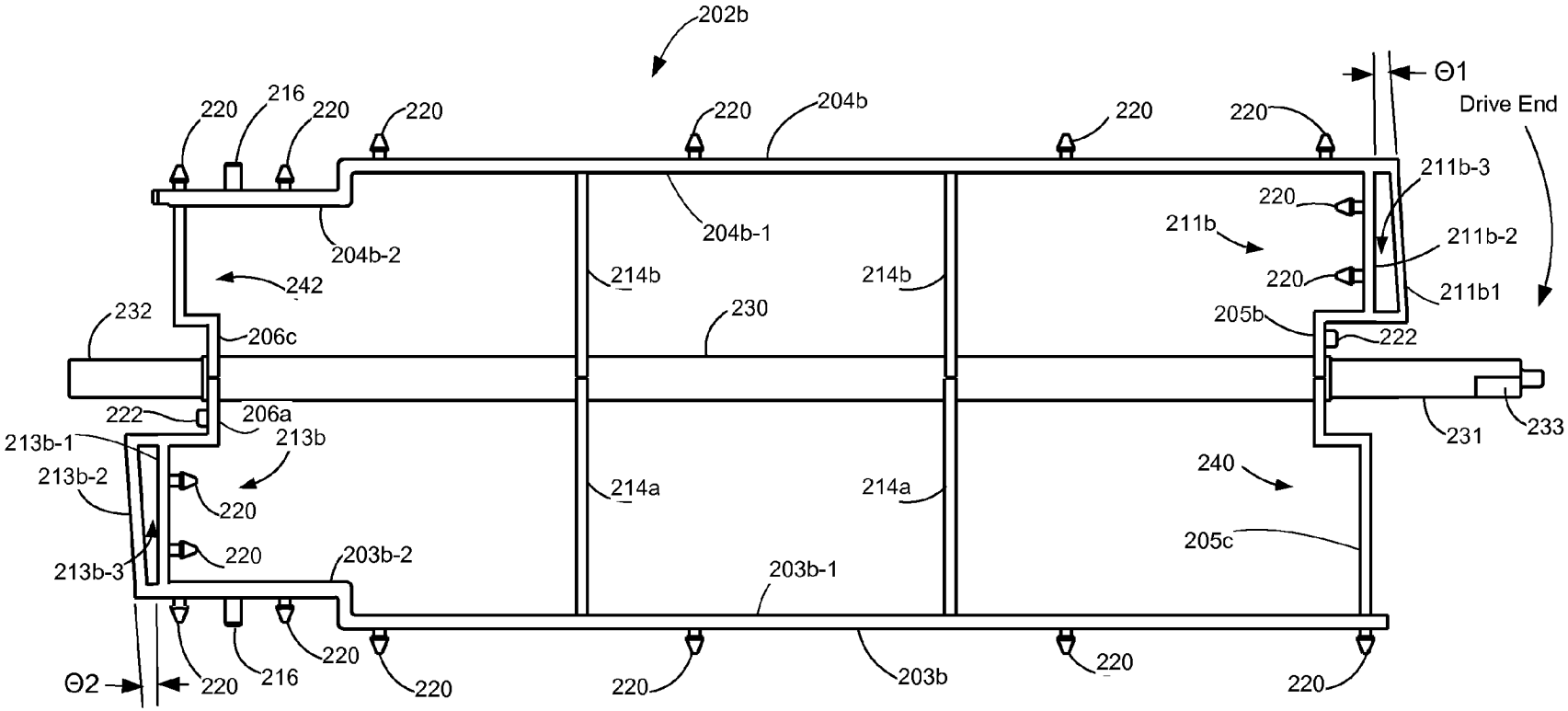
FIG. 9 is a view of another example embodiment of a toner paddle frame without a breaker bar attached to the cross member with the cross member having stepped or offset portions.

Referring to FIG. 9, another example embodiment of a frame is illustrated. There frame 202*b* is similar to frame 202*a*. Like elements in frame 202*b* to those in frame 202*a* will have like reference numerals. Frame 202*b* is formed by two sets of aligned arms extending radially from drive shaft 230. Frame 202*b* may be molded unitarily with the drive shaft 230. The first set of aligned arms includes first and second end members 205*c*, 206*a*, and a plurality of rib members 214*a* interspaced between first and second end members 205*c*, 206*a*. A front cross member 203*b* connects the distal ends of the first set of arms. Front cross member 203*b* includes a first segment 203*b*-1 for mounting a main scraper 250*a*, and a second segment 203*b*-2 for mounting a secondary scraper 260*a*. Rear cross member 204*b* connects the distal ends of the second set of arms. The second set of aligned arms extend radially opposite the arms of the first set and include first and second end members 205*b*, 206*c*, and a plurality of rib members 214*b* interspaced between first and second end members 205*b*, 206*c*. The end members and ribs stiffen frame 202*b*. Rear cross member 204*b* includes a first segment 204*b*-1 for mounting a main scraper 250*b*, and a second segment 204*b*-2 for mounting a secondary scraper 260*b*. Cross member 204*b*, as illustrated, is a mirror image of cross member 203*b*. First segments 203*b*-1, 204*b*-1 and second segments 203*b*-2, 204*b*-2 have lengths corresponding to the length of the open portion 128*a* and enclosed portion 128*b*, respectively, of channel 128.

As illustrated end members 205*c*, 206*c* extending radially from drive shaft 230 have offset portions 240, 242 respectively, which in this instance is a matter of design choice. These portions 240, 242 do not mount a side scraper and thus do not have inner and outer members as previously described for offset portions such as offset portions 211*a*, 213*a*. End members 205*b*, 206*a* include axially offset portions 211*b*, 213*b*, respectively, each for mounting side scrapers 270*b*, 270*a*, respectively. Offset portions 211*b*, 213*b* are substantially similar to offset portions 211*a*, 213*a*. Offset portions 211*b*, 213*b*, each further comprise a radially extending outer member 211*b*-1, 213*b*-1, and a radially extending inner member, 211*b*-2, 213*b*-2 having an opening 211*b*-3, 213*b*-3, respectively, therebetween. Inner member 211*b*-2, 213*b*-2 is axially inward of outer member 211*b*-3, 213*b*-1. One or more mounting stakes 220 are used to secure side scrapers 270*b*, 270*a* to the offset portions 211*b*, 213*b* Inner member 211*b*-2 is generally parallel to side wall 114 while outer member 211*b*-1 forms the acute angle θ1 (in one example embodiment this angle is about 3.6 degrees) with its inner member 211*b*-2. Inner member 213*b*-2 is generally parallel to side wall 116 while outer member 213*b*-1 forms the acute angle θ2 (in one example embodiment this angle is about 4.6 degrees) with its inner member 213*b*-2. Each main scraper 250*a*, 250*b* is mounted on an outer surface of first segments 203*b*-1, 204*b*-1 of the cross members 203*b*, 204*b*, respectively. First segments 203*b*-1, 204*b*-1 and second segments 203*b*-2, 204*b*-2 have lengths corresponding to the length of the open portion 128*a* and enclosed portion 128*b*, respectively, of channel 128. The main and secondary scrapers may also be mounted from the inner surfaces of the cross members. Because the frame 202*b* is intended for use in a toner cartridge that has less toner capacity than the toner cartridge in which frame 202*a* is intended for use, offset portions 203*b*-2, 204*b*-2 are not angled to increase the scraping force of secondary scrapers 260*a*, 260*b* to direct toner into the first region of the cartridge swept by main scrapers 250*a*, 250*b*.

The frame 202*b* may also include one or more centering posts 222 positioned near the drive shaft 230 and extending axially outwardly from the end members. As shown a centering post 222 axially extends from each of the first end member 205*b* and second end member 206*a* in parallel with the drive shaft 230 and perform as previously described. A plurality of extension ribs extending radially outwardly from each of the front cross member 203*b* and rear cross member 204*b*, respectively, along with a breaker bar may also be used and function as previously described.

Figure 10:
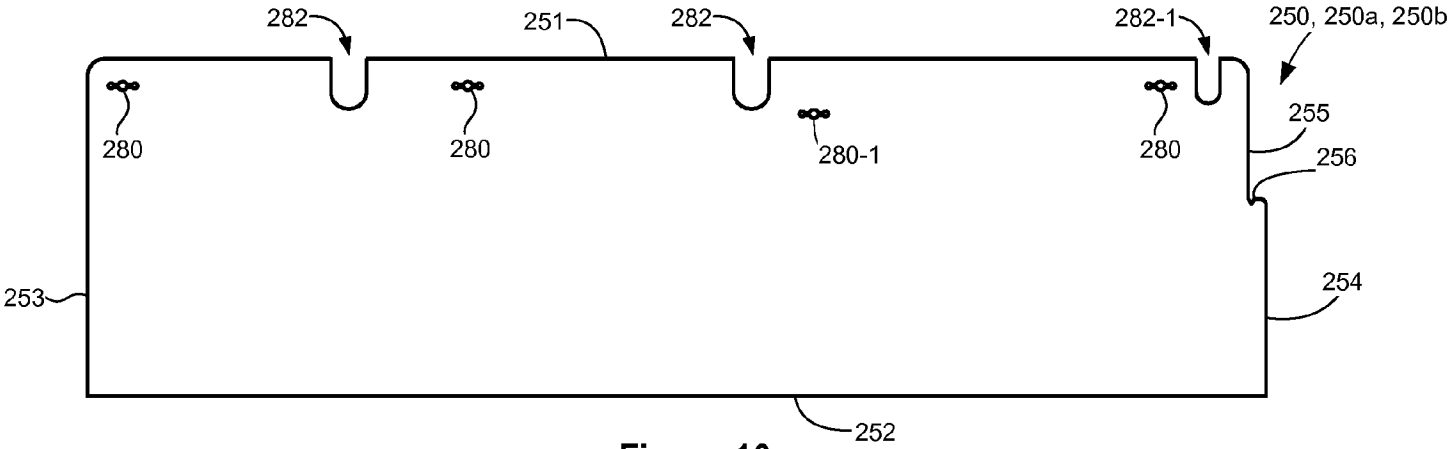
FIG. 10 is a view of an example embodiment of a main scraper for use in a toner paddle.

Referring to FIG. 10, the main scraper 250, 250*a*, 250*b* generally has a rectangular shape having a top edge 251, a bottom edge 252, an inner edge 253 and an outer edge 254. Outer edge 254 is adjacent on the side walls 114, 116. Outer edge 254 also has a notch 255 having a catch 256. Upon placement of the toner paddle assembly 200 in the toner cartridge, the main scraper 250 flexes against the inner wall of the housing 101. As such, the main scraper 250 maintains an interference contact with the inner wall of the housing 101 along distal edge 252. The main scraper 250, 250*a*, 250*b* has a plurality of spaced mounting holes 280 located adjacent the top edge 251 through which pass corresponding mounting stakes 220 formed on the cross members 203, 203*a*, 203*b*, 204, 204*a*, 204*b*. It may be appreciated that in order to ensure the correct orientation of the main scraper 250, 250*a*, 250*b* on their respective cross members at least one of the mounting holes 280 may be offset from the rest of the mounting holes 280 (see mounting hole 280-1). Mounting holes 280 may be slotted to allow for tolerance stack up differences between the location of the mounting holes on the main scraper and the locations of mounting stakes 220 on the cross members or end members. A slight bowing of the main scraper 250, 250*a*, 250*b* may occur because of tolerance stackup but this does not affect its functionality. Further, the main scrapers 250*a*, 250*b* may include a plurality of slots 282 formed on the top edge 251 to accommodate the plurality of rib extensions 216*a*, 216*b* formed on the cross members 203*a*, 204*a*. Similarly, at least one of the slots 282 (see slot 282-1) may be of a different width from the rest of slots 282 to ensure that the main scraper 250, 250*a*, 250*b* is mounted in the correct orientation on their respective cross members.

To reliably deliver a continuous and substantially equal amount of toner from the toner reservoir 118 into open portion 128*a* of channel 128, it is important that the main scraper 250, 250*a*, 250*b* maintain an interference contact with the inner wall of the housing 101 to provide effective scraping and, in particular, as it ascends the interior surface of the front 110 wall to deliver toner into channel 128. It has been determined experimentally that a main scraper having a height that is too short would allow some toner to drop back into the toner reservoir 118, and that a main scraper having a height that is too long would not be able to effectively scrape toner as the main scraper would just ride out over the toner. Both conditions may lead to toner starvation. In one example embodiment, in a toner cartridge having a toner reservoir with a radius of about 7.5 cm, the radial length of the aligned arms 205, 205*a*, 206, 206*a* is designed to be 5 cm and the height of the main scraper 250, 250*a*, 250*b* measured along the inner edge 253 is designed to be about 5 cm. In another example embodiment, in a toner cartridge having a toner reservoir with a radius of about 5.5 cm, the radial length of the aligned arms 205, 205*a*, 206, 206*a* is designed to be approximately 4 cm and the height of the main scraper 250, 250*a*, 250*b* measured along the inner edge 253 is designed to be about 5.5 cm.

As stated above, channel 128 includes an open portion 128*a* and an enclosed portion 128*b* enclosing a shutter assembly (not shown). Because of this the reservoir can be thought of has having a first region 118*a* corresponding to the open portion 128*a* of channel 128 and a second region 118*b* corresponding to the enclosed portion 128*b* of channel 128 (see FIG. 5). Because of the shutter assembly structure, toner in the second region 118*b* of the toner reservoir 118 cannot be effectively delivered into the open portion 128*a* of channel 128. It has been found that extending main scraper 250, 250*a*, 250*b* along the entire length of the cross member 203, 203*a*, 204*a*, 203*b*, 204*b* was not effective in delivering toner from this second region of the toner reservoir. As such, the main scraper 250, 250*a*, 250*b* is dimensioned to scrape toner located in the first region 118*a* of the toner reservoir 118. In line with this, the toner paddle assembly 200 is provided with a secondary scraper 260, 260*a*, 260*b* mounted on each of the second segments 203-2, 203*a*-2, 204*a*-2, 203*b*-2, 204*b*-2 of the cross members. Each of the secondary scrapers 260, 260*a*, 260*b* is positioned in an abutting and partial overlapping relationship with a corresponding main scraper 250, 250*a*, 250*b*.

Figure 11:
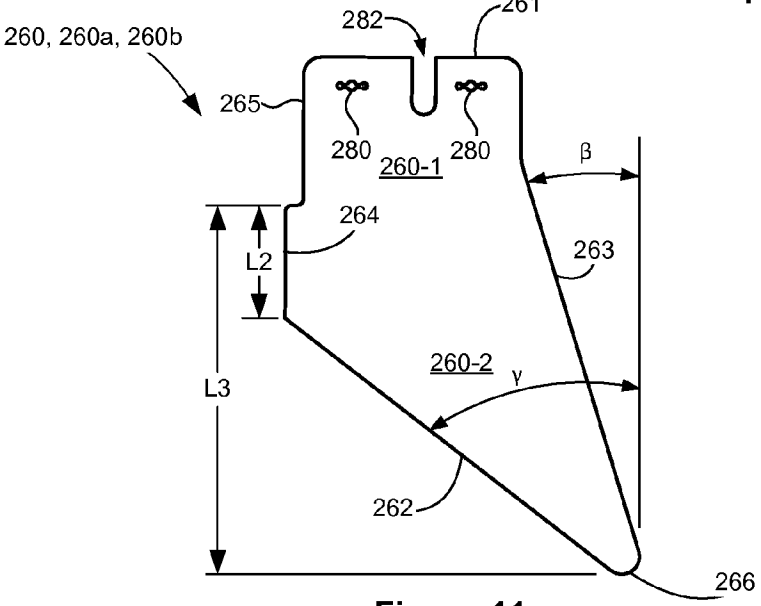
FIG. 11 is a view of an example embodiment of a secondary scraper for use in a toner paddle.

Referring to FIG. 11, the secondary scraper 260, 260*a*, 260*b* has a top edge 261, a bottom edge 262, an inner edge 263, and an outer edge 264 that is positioned adjacent one of the side walls 114, 116. Outer edge 264 has a notch 265 beginning at top edge 262 and extending along a portion of outer edge 264. The second scraper 260, 260*a*, 260*b*, generally has a tapered or skewed triangular distal portion 260-2 with a generally rectangular attachment portion 260-1. The tapered distal portion 260-2 is formed between inclined bottom and inner edges 262, 263. A lower portion of inner edge 263 is at an angle with respect to vertical while bottom edge 262 is at an angle $\gamma$ where $\beta<\gamma$ allowing their meeting at the apex 266 of the distal portion 260-2. In one example embodiment angle is about 17 degrees and angle $\gamma$ is about 66 degrees while in another example embodiment angle is about 14.9 degrees and angle $\gamma$ is about 52 degrees. These angles help determine the amount of overlap between the distal portion 260-2 and the inner edge 253 of main scraper 250, 250*a*, 250*b*. The amount of overlap is a matter of design choice. As such, the distal portion 260-2 of the secondary scraper 260, 260*a*, 260*b* has a first and second cantilevered length L2, L3, the first cantilevered length L2 measured from the bottom of notch 265 along outer edge 264 and the second cantilevered length L3 measured from the bottom of notch 265 to the apex 266 of the distal portion 260-2. Therefore, the first cantilevered length L2 is shorter than the second cantilevered length L3. In one example embodiment L2 and L3 are about 19 mm and 65 mm, respectively, while in another example embodiment L2 and L3 are about 10.5 mm and 32.5 mm, respectively.

Figure 16:
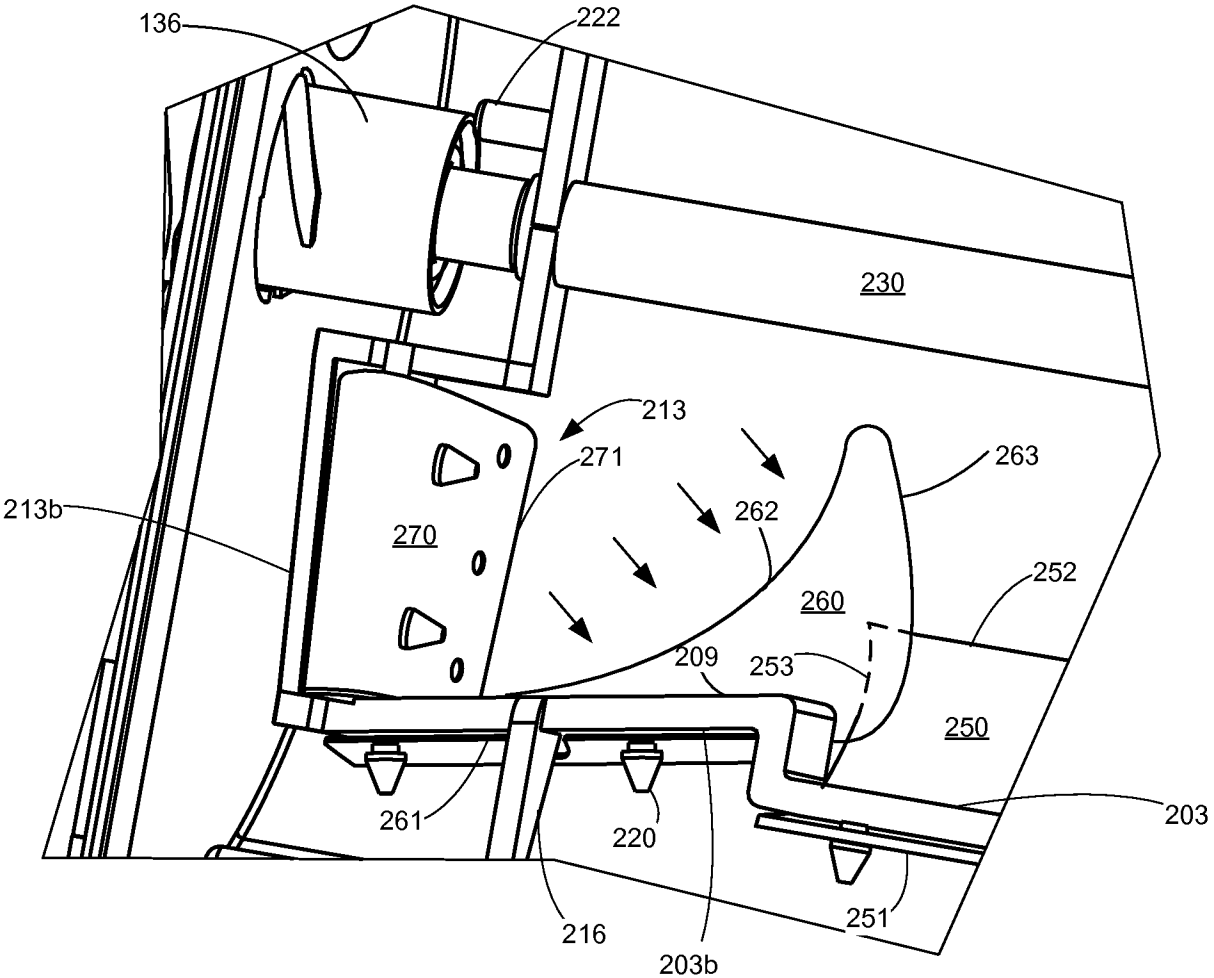
FIG. 16 is an illustration of the toner cartridge showing toner movement from a second region of the reservoir into a first region of the reservoir by the scraping action of the secondary scraper.

Upon placement of the toner paddle assembly 200 in the toner cartridge 100, the secondary scraper 260, 260*a*, 260*b* flexes against the inner wall of the housing 101. This enables the secondary scraper 260, 260*a*, 260*b*, to be at an angle where the bottom edge 262 meets the inner wall of the housing 101. This angle applies a twisting force to the secondary scraper 260, 260*a*, 260*b*, such that toner scraped by the secondary scraper 260, 260*a*, 260*b* is directed towards the main scraper 250, 250*a*, 250*b*. Referring back to FIG. 7, a portion of the distal portion 260-2 along bottom edge 262 of the secondary scraper 260, 260*a*, 260*b* extends beyond the bottom edge 252 of the main scraper 250, 250*a*, 250*b* and is positioned behind an adjacent inner edge 253 of the main scraper 250, 250*a*, 250*b*. This overlap allows the secondary scraper 260, 260*a*, 260*b* to remove residual toner that would be left if there was a gap between the main scraper 250, 250*a*, 250*b* and secondary scraper 260, 260*a*, 260*b*. The overlap assists the secondary scraper 260, 260*a*, 260*b* to move toner located in a second region 118*b* as indicated by the arrows illustrated in FIG. 16 of the toner reservoir 118 into the first region 118*a*. As a result, toner is aggregated at the first region 118*a* of the toner reservoir 118. In an example embodiment, a portion of bottom edge 262 and a portion of inner edge 263 near apex 266 of the secondary scraper 260, 260*a*, 260*b* extend beyond inner edge 253 of the main scraper 250, 250*a*, 250*b* by about 5 to about 15 mm. It can be appreciated that edges 262, 263 of the secondary scraper 260, 260*a*, 260*b* can be made to overlap the main scraper 250 to a smaller or larger extent but this would entail decreasing or increasing the size of the secondary scraper 260, 260*a*, 260*b*. It will also be appreciated that as the flexed bottom edge 262 of secondary scrapers 260, 260*a*, 260*b* and the distal end or bottom edge 252 of the main scraper 250, 250*a*, 250*b*, rotate past the open portion 128*a* of channel 128, they flick outwardly helping to throw the toner being carried by these scrapers into the channel 128 and off of their front surfaces. This helps to reduce the amount of residual toner within toner cartridge 100.

The secondary scrapers 260, 260*a*, 260*b* have a plurality of mounting holes 280 spaced apart for assembly on the corresponding mounting stakes 220 formed on each of the second segments 203-2, 203*a*-2, 204*a*-2, 203*b*-2, 204*b*-2 of the cross members. The secondary scraper 260, 260*a*, 260*b* may include a slot 282 formed on the top edge 261 to accommodate rib extension 216 formed on each of the second segments 203-2, 203*a*-2, 204*a*-2, of cross members 203, 203*a*, 204*a*. It may be appreciated that in order to ensure the correct orientation of the secondary scraper on the cross member the horizontal distance from one of the mounting holes 280 to the slot 282 may be different from the horizontal distance from the other mounting hole 280 to the slot 282.

As illustrated in FIG. 6 the notch 265 in outer edge 264 of secondary scraper 260 allows the bottom edge 272 and outer edge 274 of side scraper 270 attached to member 213-2 to extend radially outward beyond the front face of secondary scraper 260. Similarly, the notch 255 of main scraper 250 allows the bottom and outer edges 272, 274, of side scraper 270 attached to member 211-2 to extend radially outward beyond the front face of main scraper 250. As shown in FIG. 7, notch 255 in outer edge 254 of main scraper 250*b*, allows the bottom edge 272 and outer edge 274 of side scraper 270*b* to extend radially outward beyond the front face of main scraper 250*b*. Notch 265 in the outer edge 264 of secondary scraper 260*a* allows the bottom edge 272 and outer edge 274 of side scraper 270*a* to extend radially outward beyond the front face of secondary scraper 260*a*. Because of these various notches, side scrapers 270, 270*a*, 270*b* are able to reach into the junction formed between side walls 114, 116, front and rear wall 110, 112, top 106, and bottom 108 to achieve more effective removal of toner adhering to side walls 114, 116.

Referring back to FIG. 7, the second segments 203*a*-2, 204*a*-2, of cross members 203*a*, 204*a*, respectively, may include an extension 218*a*, 218*b* projecting therefrom generally in line with the plane of secondary scraper 260*a*, 260*b* for providing a force to the back of each secondary scraper 260*a*, 260*b*. The extensions 218*a*, 218*b* allow the scraping force across the distal end (bottom edge 262) of secondary scraper 260*a*, 260*b* to be more evenly applied against the inner wall of the housing 101. An uneven scraping force leaves sections of residual toner that is not delivered from the second region 118*b* to the first region 118*a* of the toner reservoir 118. Extensions may be provided on any of the various illustrated embodiments of the frames.

Referring to FIG. 8, the second segments 203*a*-2, 204*a*-2 of cross members 203*a*, 204*a*, respectively, may be an angle α with respect to the first segments 203*a*-1, 204*a*-1. This enables the secondary scrapers 260*a*, 260*b* to have a steeper angle where bottom edge 262 meets the inner wall of the housing 101 which helps to increase the axial force for moving of residual toner from the second region 118*b* towards the first region 118*a*. In an example embodiment, although the angle α may be set to 10 degrees, the angle α may be within the range of about 10 to about 15 degrees. When the angle α is less than 5 degrees, the axial force of the secondary scraper 260*a*, 260*b* may not be enough to move toner towards the main scraper. Meanwhile, when the angle α exceeds 15 degrees, the apex 266 on the distal portion 260-2 of secondary scrapers 260*a*, 260*b* becomes too long and interferes with the ultrasonic welding of the top 106 to base 102. Also by steepening the angle α, the longer the distal portion 260-2 must be in order to overlap behind main scraper 250, 250*a*, 250*b*. The second segment 203-2 of cross member 203 is also illustrated as being angled.

Figure 12:
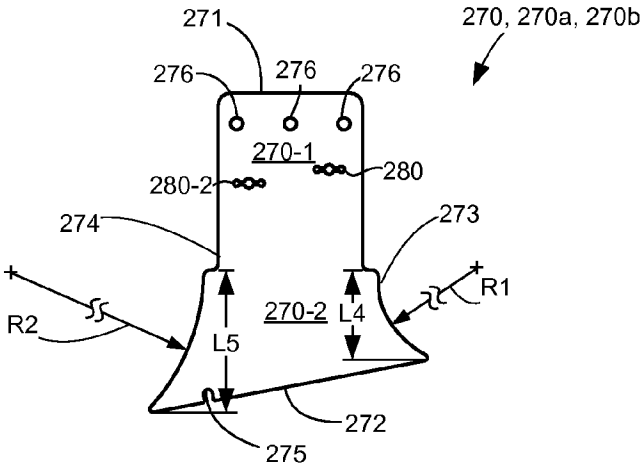
FIG. 12 is a view of an example embodiment of a side scraper for use in a toner paddle.

Referring to FIGS. 6, 7, and 12-15, the toner paddle assembly 200 according to an example embodiment may include a side scraper 270, 270*a*, 270*b* mounted on offset portions of frames 202, 202*a*, 202*b* for scraping the interior surfaces of side walls 114, 116. The side scraper 270, 270*a*, 270*b* has a top edge 271, a bottom edge 272, and inner edge 273 adjacent the drive shaft 230 and an outer edge 274. The side scraper 270, 270*a*, 270*b* includes a generally rectangular base 270-1 and a diverging or fluted distal end portion 270-2 having a first cantilevered length L4 along inner edge 273 and a second cantilevered length L5 along outer edge 274. The first cantilevered length L4 is shorter than the second cantilevered length L5 making bottom end 272 angle upward, as illustrated in FIG. 12, from the outer edge 274 toward the inner edge 273. The first cantilevered length L4 diverges from the base 270-1 with a first radius of curvature R1 and the second cantilevered length L5 diverges from the base 270-1 with a second radius of curvature R2, the first radius of curvature R1 smaller than the second radius of curvature R2. This structure of the side scraper 270, 270*a*, 270*b* allows for a maximum area of the side walls 114, 116 to be scraped by the side scraper 270, 270*a*, 270*b* during the rotation of the toner paddle assembly 200. The two different radii, R1, R2 allow the stiffness of distal portion 270-2 to be generally uniform along the length of bottom edge 272. In one embodiment L4 may be about 15 mm, L5 about 23 mm, R1 may be about 16 mm and R2 may be about 33 mm.

Figure 13:
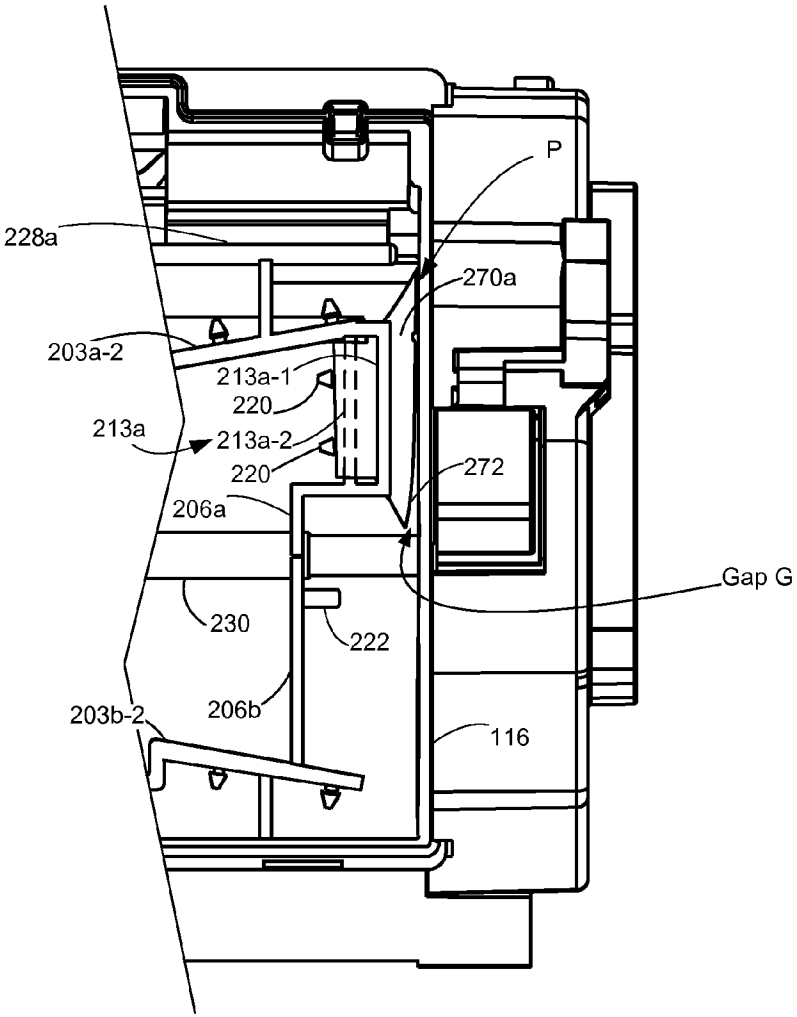
FIG. 13 is an illustration of a portion of a toner cartridge showing a toner paddle having a side scraper having a gap between the distal end of the side scraper and the sidewall of the housing.

Shown in FIG. 13, is an embodiment having the outer and inner members 213*a*-1, 213*a*-2 of offset portion 213*a* both being parallel to one another and to side wall 116. However because the material of the side scraper 270, 270*a*, 270*b* is homogeneous, the longer second cantilevered length L5 does not have as much beam strength as the shorter first cantilevered length L4. As a result, when the side scraper 270, 270*a*, 270*b* is placed against the side wall 114, 116, as applicable, the first point of contact for the side scraper 270, 270*a*, 270*b* is the point indicated by P or the longer second cantilevered length L5 corner. As the second cantilevered length L5 corner deflects when the side scraper 270, 270*a*, 270*b* is pressed against the side wall 114, 116, the shorter first cantilevered length L4 corner, because of its higher stiffness, deflects away the bottom edge 272 away from the side wall 114, 116, forming a gap G between the bottom edge 272 of side scraper 270, 270*a*, 270*b* and side wall 114, 116. This results in areas of the side wall 114, 116 not being scraped.

Figure 14:
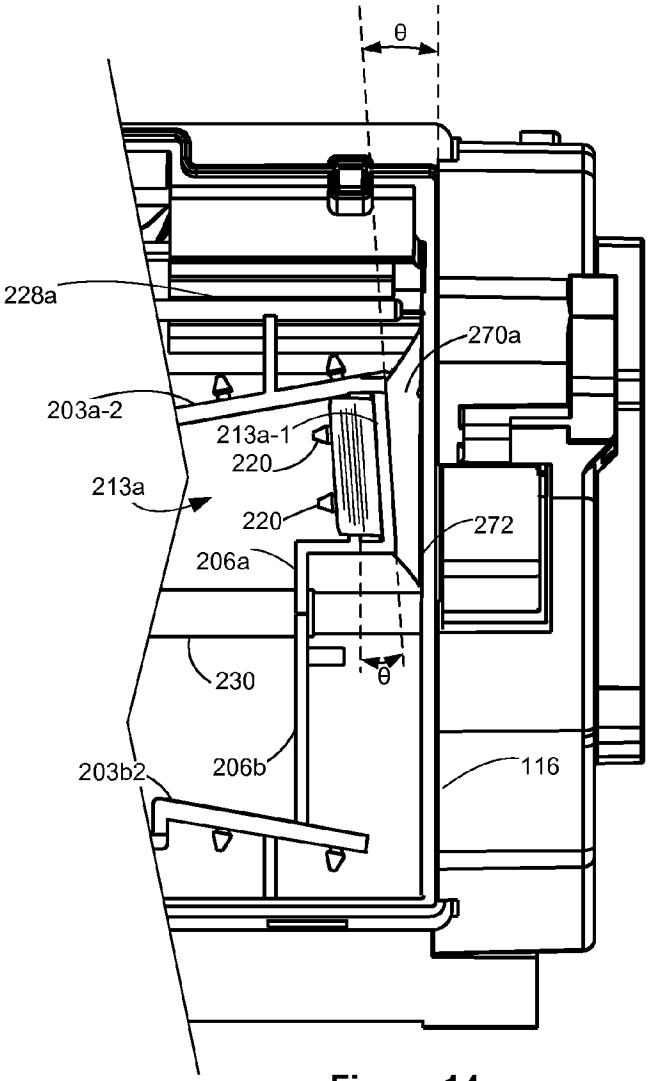
FIG. 14 is an illustration of a portion a toner cartridge showing an example embodiment of a toner paddle having an angled offset arm for mounting a side scraper wherein no gap exists between the distal end of the side scraper and the sidewall of the housing.
Figure 15:
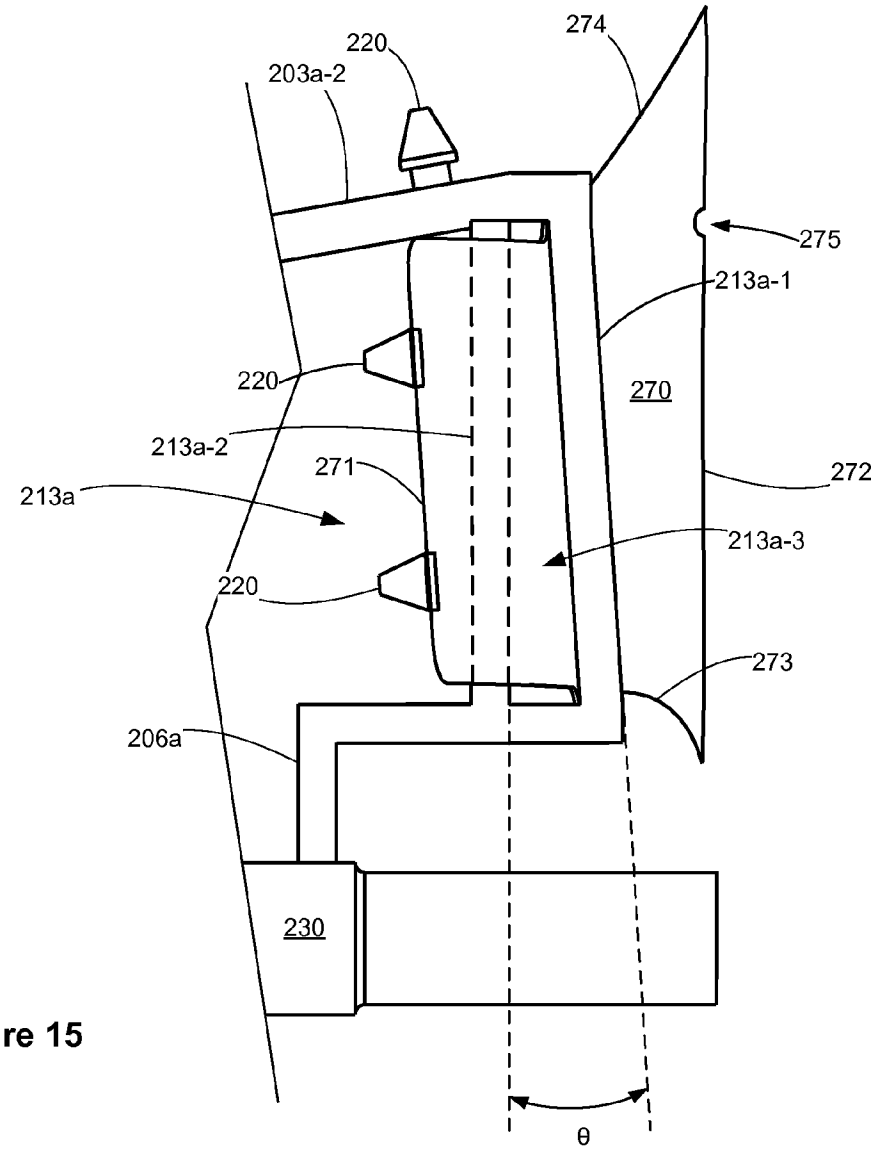
FIG. 15 is a detail view of the side scraper mounting for the toner paddle shown in FIG. 14.

Referring to FIG. 14, it was found that by positioning the outer member 213*a*-1 of offset portion 213*a* at an acute angle θ with respect to the inner member 213*a*-2*a* essentially eliminates the gap G and ensures a more uniform scraping force across the entire scraping length of the side scraper 270*a* along bottom edge 272. As viewed in FIG. 14, outer member 213*a*-2 angles inwardly from the drive shaft 230 toward cross member 203*a*. The magnitude of angle θ is between 3 to 5 degrees and is dependent on the material and its thickness that is used to make side scraper 270, 270*a*, 270*b*. By angling the outer members of offset portions having side scrapers, each side scraper is also pre-angled with respect to the side wall such that the corner of inner edge 273 hits the side wall before the corner of outer edge 274 does. As a result, the side scrapers are ensured to have a more uniform scraping force across the scraping length along its bottom edge 272. The outer members 211-1, 211*a*-1, 211*b*-1, 213, 213*b*-1 are similarly angled with respect to their respective inner members.

The side scraper 270, 270*a*, 270*a* has a plurality of mounting holes 280 spaced apart for assembly on the corresponding mounting stakes 220 formed on the inner side of each of inner members 211 *a*-2, 213*a*-2. It may be appreciated that in order to ensure the correct orientation of the side scraper 270, 270*a*, 270*b* the vertical distance from one of the mounting holes 280 to the top edge 271 of the side scraper 270, 270*a*, 270*b* may be different from the vertical distance from another mounting hole 280 to the top edge 271 (see mounting hole 280-2 in FIG. 12).

In an example embodiment, the side scrapers 270, 270*a*, 270*b* include a plurality of assembly holes 276 positioned near the top edge 271. These holes 276 are used for facilitating the mounting of side scrapers 270, 270*a*, 270*b* on the respective offset portions 211, 211*a*, 211*b*, 213, 213*a*, 213*b*. A tool having pegs is inserted into assembly holes 276 and is used to pull top edge 271 through the space 211-3, 211*a*-3, 211*b*-3, 213-3, 213*a*-3, 213*b*-3 formed on offset portion 211, 211*a*, 211*b*, 213, 213*a*, 213*b* and to aid in bending the base portion 270-1 of side scraper 270, 270*a*, 270*b* to wrap over the inner member 211-2, 211*a*-2, 211*b*-2, 213-2, 213*a*-2, 213*b*-2.

Figure 18:
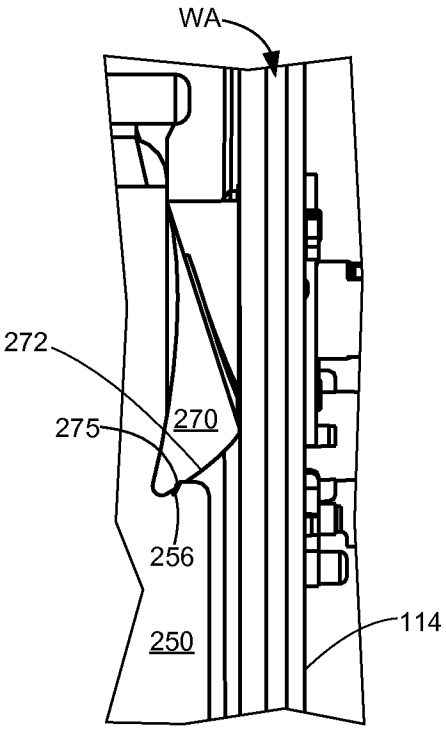
FIG. 18 is a detailed view of a portion of a toner cartridge shown in FIG. 17 showing an example embodiment of a toner paddle having the distal end of its side scraper inserted into a notch formed on the side edge of the main scraper and pulled away from the weld area.
Figure 17:
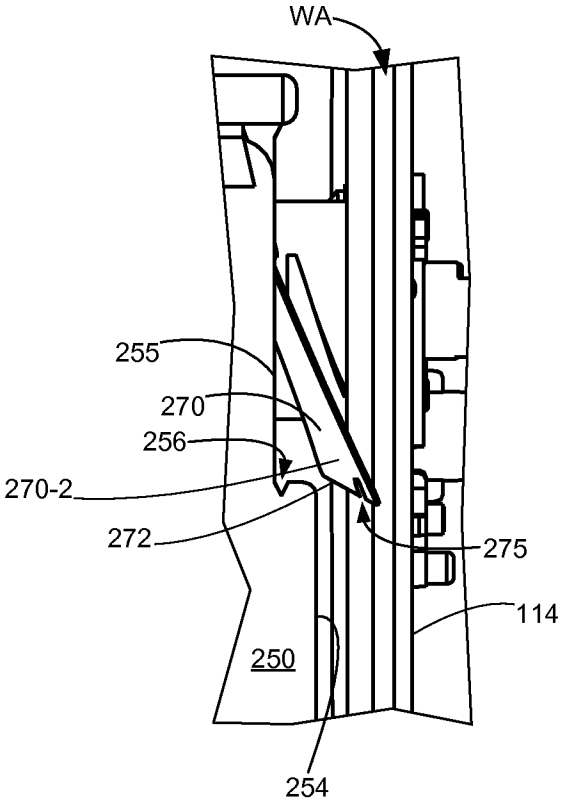
FIG. 17 is a detailed view of a portion of a toner cartridge illustrating the distal end of the side scraper interfering with the weld area between the base and top of the cartridge.

Referring now to FIGS. 7, 17 and 18, with the toner paddle assembly 200*a* mounted within the reservoir 118, assembly of the top 106 to the base 102 must ensure that the main, secondary and side scrapers found on the frame 202*a* do not interfere with the weld area WA between the rim of the top 106 and the rim of base 102 during the ultrasonic welding of these two pieces. During assembly, one orientation of paddle assembly 200*a* in the base 102 would be as shown in FIG. 7 where main scraper 250*a*, secondary scraper 260*a* and side scraper 270*a* are positioned in toner reservoir 118 and out of the way between the weld area WA between the top 106 and base 102. Because of the notch 265 on secondary scraper 260*a*, secondary scraper 260*a* does not need to have a catch like catch 256 to hold side scraper 270*a* away from the weld area WA. However, main scraper 250*b*, secondary scraper 260*b*, and side scraper 270*b* extend vertically upward with the distal portion of side scraper 270*b* flexing outward over side wall 114 into the weld area WA (see FIG. 17). As the top 106 is brought down to welding position with the base 102, main scraper 250*b* and secondary scraper 260*b* will bend inwardly against the interior of the top 106 and be moved out of the weld area WA. However the distal portion 270-2 of side scraper 270*b* may become caught between the top 106 and base 102. If the side scraper 270*b* is pinched between the top 106 and base 102, the toner paddle assembly 200*a* may not be able to rotate, may tear on rotation of the paddle assembly 200*a*, and the weld in that area may be weakened resulting in toner leaks. To prevent this interference by side scraper 270*b*, the catch 256 in notch 255 is provided on the outer edge 254 of main scraper 250*b*. The bottom edge 272 of the side scraper 270*b* is bent to engage with catch 256. By doing this, the side scraper 270*b* is pulled away from the weld area WA. This allows the top 106 to be welded to the base 102 lo without pinching the side scraper 270*b*. Once welded, upon the first rotation of the paddle assembly 200*a*, the main scraper 250*b* flexes as it compresses against the inner walls of housing 101. The main scraper 250*b* flexes to a point where catch 256 in notch 255 lines up with a notch 275 in the bottom edge 272 of side scraper 270*b*. When catch 256 and notch 275 line up, the side scraper 270*b* slides off of catch 256, is released and begins to scrape the inner side of walls 116 of toner reservoir 118. The side scraper 270*b* is said to be self-releasing. It should be realized that if the orientation of paddle assembly 200*a* were reversed during assembly, then a catch may be provided in secondary scraper 260*a* to engage with bottom edge 272 of side scraper 270*a*.

For manufacturing economies, the main scrapers 250*a*, 250*b*, secondary scrapers 260*a*, 260*b*, and side scrapers 270*a*, 270*b*, respectively, are designed to be identical. This results in main scraper 250*a*, secondary scraper 260*b*, and side scraper 270*a* having nonfunctional features. Thus the notch 255 and catch 256 on main scraper 250*a* is not used. Similarly, the notch 265 on secondary scraper 260*b* and the notch 275 on side scraper 270*a* are not used.

The main scrapers 250, 250*a*, 250*b* and the secondary scrapers 260, 260*a*, 260*b* may be formed from flexible sheet members, for example, of polycarbonate material. In an example embodiment, the thickness of the polycarbonate scrapers is within a range of 0.373 to 0.389 millimeters. Meanwhile, the side scraper 270, 270*a*, 270*b* may be formed from a flexible sheet, for example, Polyethylene Terephthalate Polyester (PET) plastic sheet. In an example embodiment, the thickness of the PET for side scraper 270, 270*a*, 270*b* may be in the range of 0.246 to 0.262 millimeters.

It can therefore be appreciated that the embodiments of the toner cartridge and the toner paddle illustrated and described herein may extend the ability of the toner delivery system to provide a reliable and consistent supply of toner to an image forming apparatus until the toner cartridge is empty, thus minimizing the residual toner left in the toner cartridge at the end of life. However, numerous additional modifications and variations are possible in light of the above teachings. It is therefore to be understood that within the scope of the appended claims, the disclosure of this patent specification may be practiced otherwise than as specifically described herein.

What is claimed is:

1. A toner cartridge for an imaging device, the toner cartridge comprising:

a housing comprising a top, a front, a rear, a bottom, a first side, and a second side forming an enclosed reservoir for holding a quantity of toner;

an exit port on the housing near the second side for transferring toner out of the reservoir;

a channel running across the front of the housing between the first side and the second side in fluid communication with the exit port, a first portion of the channel extends from the first side toward the second side and is open to the reservoir and a second portion of the channel extends from the second side toward the first side and is closed to the reservoir; and a paddle assembly mounted within the enclosed reservoir, the paddle assembly comprising:

a rotatable drive shaft extending across the reservoir from the first side to the second side, the drive shaft having an axis of rotation;

a frame radially extending from the drive shaft, a distal end of the frame is positioned at an outer radial end of the frame relative to the shaft;

a first scraper extending in its free state in a cantilevered manner from the distal end of the frame and extending in its free state in a direction generally orthogonal to the radial extension of the frame and to the axis of rotation of the drive shaft, the first scraper positioned to have an interference contact with the front of the housing along the first portion of the channel upon rotation of the drive shaft; and a second scraper extending in its free state in a cantilevered manner from the distal end of the frame and extending in its free state in the direction generally orthogonal to the radial extension of the frame and to the axis of rotation of the drive shaft, the second scraper having a cantilevered length measured along a direction that the second scraper extends in the cantilevered manner from the distal end of the frame that varies along the axial direction of the drive shaft, the second scraper positioned to have an interference contact with the front of the housing along the second portion of the channel upon rotation of the drive shaft, wherein upon rotation of the drive shaft, the first scraper and the second scraper deliver toner from the enclosed reservoir to the first portion of the channel.

2. The toner cartridge of claim 1, wherein the frame includes a plurality of aligned arms radially extending from the drive shaft.

3. The toner cartridge of claim 2, wherein the frame includes a cross member connected to distal ends of the arms.

4. The toner cartridge of claim 2, wherein one of the plurality of aligned arms is positioned proximate to the first side or the second side and further comprising a side scraper extending in a cantilevered manner from said one of the plurality of aligned arms positioned proximate to the first side or the second side and having an interference contact with the adjacent first side or second side.

5. The toner cartridge of claim 1, wherein the second scraper has a longer cantilevered length near the first scraper and a shorter cantilevered length near the second side.

6. The toner cartridge of claim 5, wherein the first scraper has a substantially constant cantilevered length.

7. The toner cartridge of claim 5, wherein the portion of the second scraper having the longer cantilevered length near the first scraper extends beyond the first scraper in a direction that the first scraper extends in the cantilevered manner from the distal end of the frame.

8. The toner cartridge of claim 1, wherein the channel is positioned higher than the axis of rotation of the drive shaft and toner from the enclosed reservoir is raised up and into the first portion of the channel by the first and second scrapers.

* * * * *